US012560349B2

(12) United States Patent
Nakanishi et al.

(10) Patent No.: US 12,560,349 B2
(45) Date of Patent: Feb. 24, 2026

(54) AIR CONDITIONING SYSTEM

(71) Applicant: DAIKIN INDUSTRIES, LTD., Osaka (JP)

(72) Inventors: Takaya Nakanishi, Osaka (JP); Yuta Fukuyama, Osaka (JP); Shinya Matsuoka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 182 days.

(21) Appl. No.: 18/522,624

(22) Filed: Nov. 29, 2023

(65) Prior Publication Data

US 2024/0093903 A1 Mar. 21, 2024

Related U.S. Application Data

(63) Continuation of application No. PCT/JP2022/022293, filed on Jun. 1, 2022.

(30) Foreign Application Priority Data

Jul. 1, 2021 (JP) ..... 2021-110175

(51) Int. Cl.
*F24F 11/84* (2018.01)

(52) U.S. Cl.
CPC ..... *F24F 11/84* (2018.01)

(58) Field of Classification Search
CPC ..... F24F 11/84; F24F 2110/12; F25B 13/00; F25B 2313/007; F25B 2313/0231;
(Continued)

(56) References Cited

U.S. PATENT DOCUMENTS

2005/0284162 A1* 12/2005 Grabon ..... F24F 11/30 62/DIG. 22
2008/0245992 A1* 10/2008 Ochoa Vivanco ..... C09K 5/042 252/67

(Continued)

FOREIGN PATENT DOCUMENTS

EP 1 655 556 B1 7/2008
GB 2566201 A 3/2019

(Continued)

OTHER PUBLICATIONS

International Search Report issued in corresponding International Application No. PCT/JP2022/022293, dated Aug. 16, 2022, with translation (5 pages).

(Continued)

*Primary Examiner* — Henry T Crenshaw
(74) *Attorney, Agent, or Firm* — Osha Bergman Watanabe & Burton LLP

(57) ABSTRACT

An air conditioning system includes: an outdoor unit that includes a first refrigerant circuit including a compressor, and a first heat exchanger; an indoor unit in a first space and that includes a second refrigerant circuit including a second heat exchanger; a liquid side pipe and a gas side pipe each connecting the first refrigerant circuit to the second refrigerant circuit; an outdoor air treatment unit including a first auxiliary refrigerant circuit including a first auxiliary heat exchanger connected to a first branching pipe branching from the liquid side pipe, and a second branching pipe branching from the gas side pipe, and a supply fan that supplies outdoor air having passed through the first auxiliary heat exchanger to the first space; a first shutoff valve on the first branching pipe; and a second shutoff valve on the second branching pipe.

6 Claims, 11 Drawing Sheets

(58) Field of Classification Search
CPC ..... F25B 2313/0233; F25B 2600/2519; F25B 2700/2106; F25B 41/24; F25B 49/02
See application file for complete search history.

(56) References Cited

U.S. PATENT DOCUMENTS

| | | | | |
|---|---|---|---|---|
| 2019/0234659 | A1* | 8/2019 | Erfurth | F25D 23/00 |
| 2020/0200448 | A1* | 6/2020 | Ito | F24F 12/006 |
| 2020/0309418 | A1* | 10/2020 | Shin | F24F 13/30 |
| 2024/0093903 | A1* | 3/2024 | Nakanishi | F25B 41/24 |

FOREIGN PATENT DOCUMENTS

| | | | | |
|---|---|---|---|---|
| JP | H02-044142 | A | | 2/1990 |
| JP | H03-020573 | | * | 1/1991 |
| JP | H03020573 | A | | 1/1991 |
| JP | 2005049059 | A | | 2/2005 |
| WO | 2018011994 | A1 | | 1/2018 |
| WO | 2019082377 | A1 | | 5/2019 |
| WO | 2019/193639 | A1 | | 10/2019 |

OTHER PUBLICATIONS

English Translation of the International Preliminary Report on Patentability issued in International Application No. PCT/JP2022/022293, dated Dec. 14, 2023 (6 pages).
Extended European Search Report issued in corresponding European Patent Application No. 22 83 2693, dated Sep. 17, 2024 (7 pages).

* cited by examiner

AIR CONDITIONING SYSTEM

TECHNICAL FIELD

The present disclosure relates to an air conditioning system.

BACKGROUND

There has been conventionally known an air conditioning system that includes a heat source unit, a plurality of utilization units, a supply air unit having an auxiliary heat exchanger, and an exhaust air unit having an auxiliary heat exchanger, the respective units being connected by pipes, and the air conditioning system is configured to individually operate and stop the units (see PATENT LITERATURE 1 or the like).

PATENT LITERATURE

PATENT LITERATURE 1: Japanese Laid-Open Patent Publication No. 3-20573

SUMMARY

An air conditioning system includes: a first unit having a first refrigerant circuit including a compressor and a first heat exchanger; a second unit disposed in a first space and having a second refrigerant circuit including a second heat exchanger; a liquid side pipe and a gas side pipe connecting the first refrigerant circuit and the second refrigerant circuit; an outdoor air treatment unit having a first auxiliary refrigerant circuit including a first auxiliary heat exchanger connected to a first branching pipe branching from the liquid side pipe and a second branching pipe branching from the gas side pipe, and a supply fan configured to supply the first space with outdoor air having passed the first auxiliary heat exchanger; a first shutoff valve provided on the first branching pipe; and a second shutoff valve provided on the second branching pipe; in which the first shutoff valve and the second shutoff valve operate to shut off a refrigerant flow between the first refrigerant circuit and the first auxiliary refrigerant circuit.

DETAILED DESCRIPTION

An air conditioning system according to the present disclosure will be described in detail hereinafter with reference to the accompanying drawings. The present disclosure should not be limited to the following exemplifications, but is intended to include any modification recited in claims within meanings and a scope equivalent to those of the claims.

Figure 1:
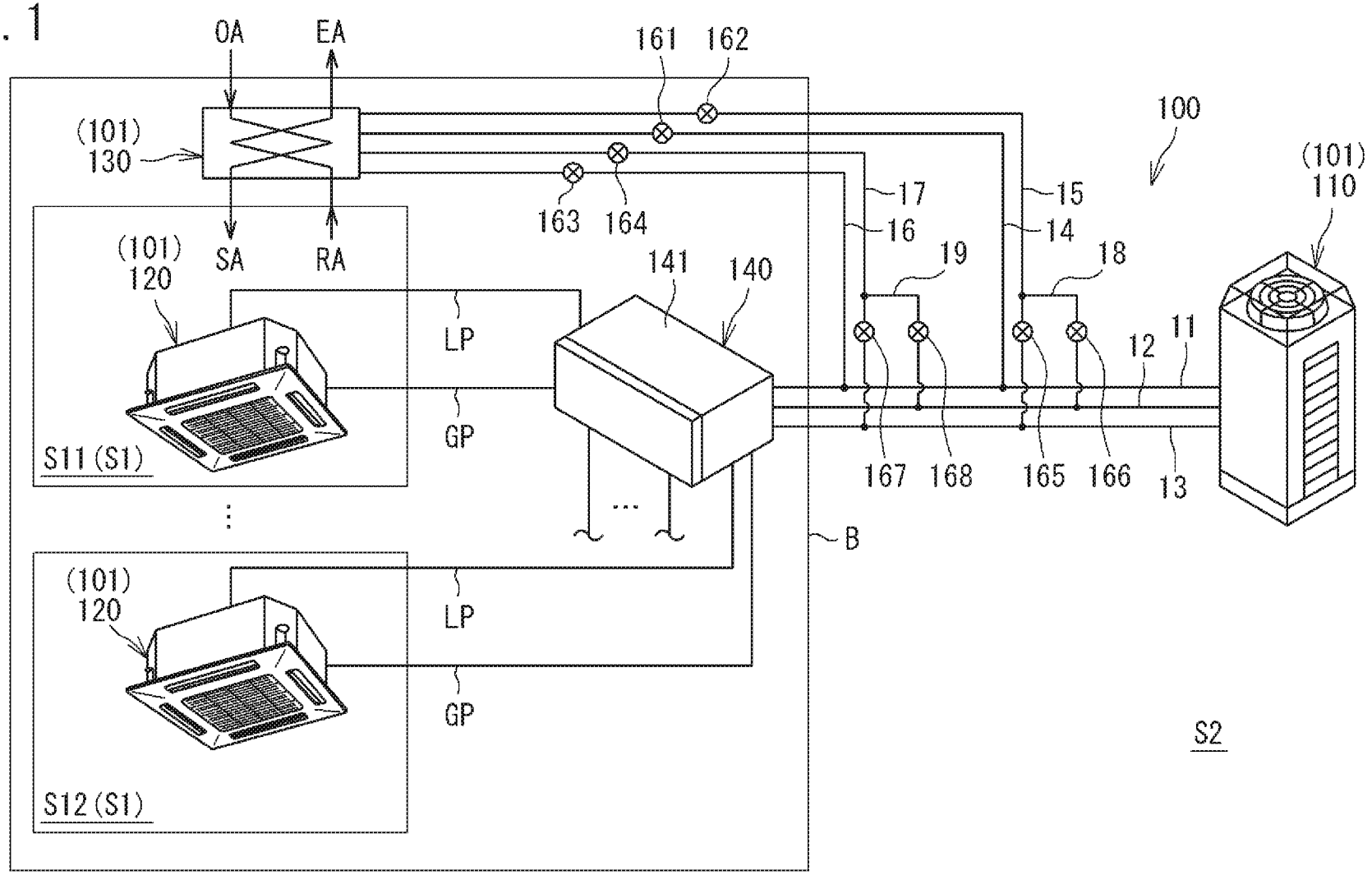
FIG. 1 is a schematic configuration diagram of an air conditioning system according to first embodiments of the present disclosure.

FIG. 1 depicts an entire configuration of an air conditioning system according to first embodiments of the present disclosure. FIG. 1 depicts an air conditioning system 100 that corresponds to the air conditioning system according to the first embodiments of the present disclosure, is installed in a building, a plant, or the like, and achieves air conditioning of an air conditioning target space. The air conditioning system 100 includes an air conditioner 101 and a refrigerant flow path switching device 140. The air conditioner 101 is configured to execute vapor-compression refrigeration cycle operation to cool or heat the air conditioning target space. The air conditioner 101 according to one or more embodiments adopts R32 as a refrigerant. Note that R32 is a refrigerant having slight combustibility.

The air conditioning system 100 is designed to perform air conditioning of an indoor space S1 provided in a building B. The building B is provided therein with a plurality of indoor spaces S1. The following description refers to a first indoor space S1 as a first space S11, a second indoor space S1 different from the first space S11 as a second space S12, and a space outside the building B as an outdoor space S2. The outdoor space S2 according to the present disclosure is an open air space.

The air conditioner 101 includes an outdoor unit 110 as a heat source unit, an indoor unit 120 as a utilization unit, and a first heat recovery unit 130. In the air conditioner 101, two or more indoor units 120 and a single first heat recovery unit 130 are connected to the single outdoor unit 110. The indoor units 120 are each connected to the outdoor unit 110 via the refrigerant flow path switching device 140. In the air conditioner 101, the refrigerant flow path switching device 140 is configured to freely select cooling operation or heating operation for each of the indoor units 120 to achieve air conditioning of the target space. One or more embodiments exemplify the air conditioning system 100 as a so-called freely cooling and heating system. Alternatively, the air conditioning system according to the present disclosure may not adopt the freely cooling and heating system.

In the air conditioning system 100, the indoor unit 120 provided for the first space S11 is configured to condition air in the first space S11, and the first heat recovery unit 130 is configured to ventilate the first space S11. In the air conditioning system 100, the indoor unit 120 provided for the second space S12 is configured to condition air in the second space S12. The outdoor unit 110 is installed in the outdoor space S2. The first heat recovery unit 130 is disposed outside the indoor space S1 in the building B.

[Configuration of Outdoor Unit]

Figure 2:
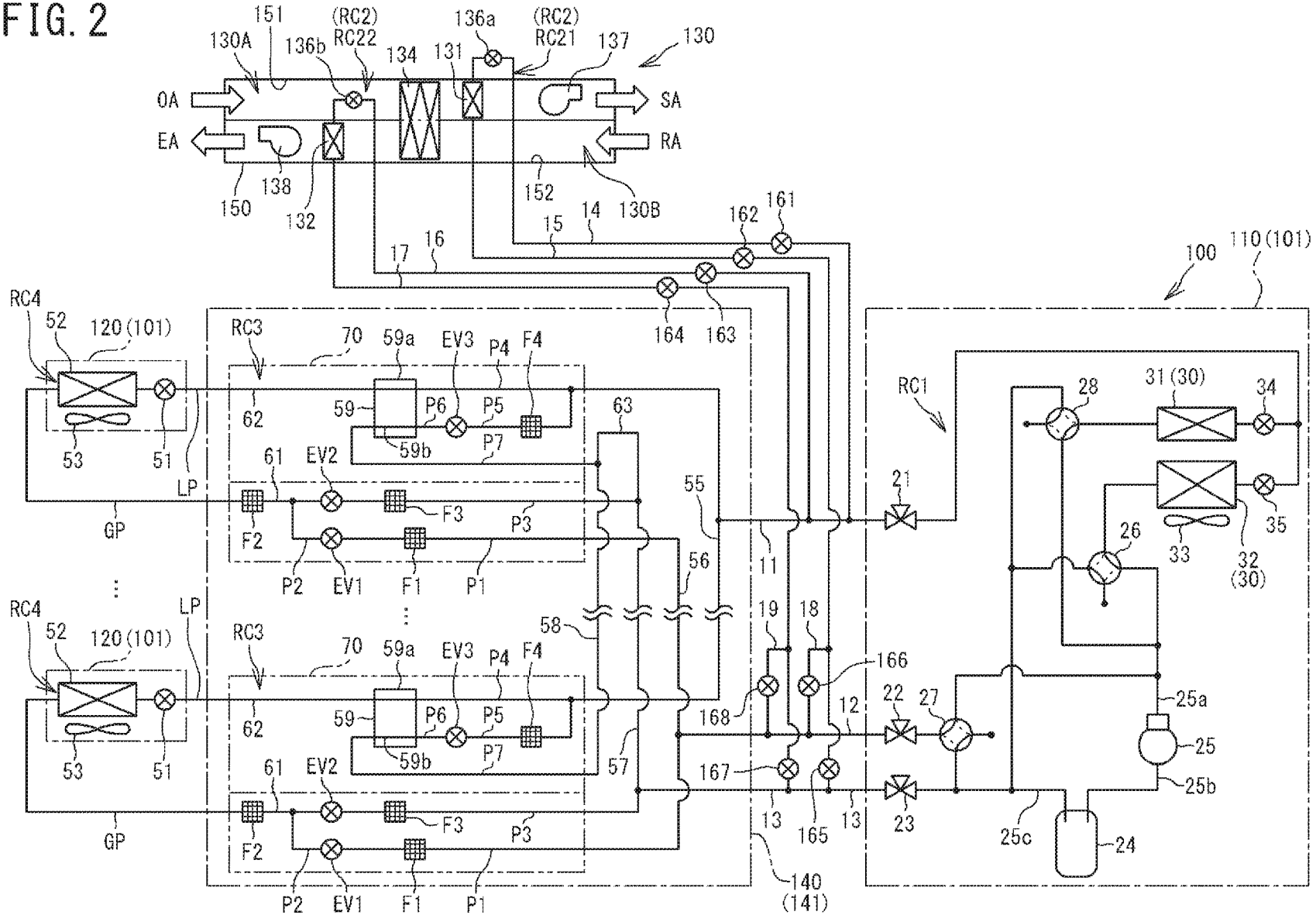
FIG. 2 is a refrigerant circuit diagram of the air conditioning system according to the first embodiments.

FIG. 2 is a refrigerant circuit diagram of the air conditioning system 100. As depicted in FIG. 1, the outdoor unit 110 is installed in the outdoor space S2 such as on a roof or a balcony or underground of the building B. As depicted in FIG. 2, the outdoor unit 110 is provided therein with various constituents that are connected via refrigerant pipes to constitute a heat source refrigerant circuit RC1. The heat source refrigerant circuit RC1 is connected to an auxiliary refrigerant circuit RC2 in the first heat recovery unit 130 and an intermediate refrigerant circuit RC3 in the refrigerant flow path switching device 140 via a first connection pipe 11, a second connection pipe 12, and a third connection pipe 13.

As depicted in FIG. 2, the heat source refrigerant circuit RC1 includes a liquid-side shutoff valve 21, a gas-side first shutoff valve 22, a gas-side second shutoff valve 23, an accumulator 24, a compressor 25, a first flow path switching valve 26, a second flow path switching valve 27, a third flow path switching valve 28, an outdoor heat exchanger 30, a first outdoor expansion valve 34, and a second outdoor expansion valve 35. The heat source refrigerant circuit RC1 is constituted by these constituents connected via a plurality of refrigerant pipes. The outdoor unit 110 is provided therein with an outdoor fan 33, a control unit 115 (see FIG. 7), and the like.

The liquid-side shutoff valve 21, the gas-side first shutoff valve 22, and the gas-side second shutoff valve 23 are manually opened and closed upon refrigerant filling, pump down, and the like. The liquid-side shutoff valve 21 has a first end connected to the first connection pipe 11. The liquid-side shutoff valve 21 has a second end connected to a refrigerant pipe extending to the first outdoor expansion valve 34 and the second outdoor expansion valve 35. The gas-side first shutoff valve 22 has a first end connected to the second connection pipe 12. The gas-side first shutoff valve 22 has a second end connected to a refrigerant pipe extending to the second flow path switching valve 27. The gas-side second shutoff valve 23 has a first end connected to the third connection pipe 13. The gas-side second shutoff valve 23 has a second end connected to a refrigerant pipe 25*c* extending to the accumulator 24.

The accumulator 24 is a container temporarily storing a low-pressure refrigerant to be sucked into the compressor 25 and used for separation between a gas refrigerant and a liquid refrigerant.

The compressor 25 has a hermetic structure incorporating a compressor motor, and is of a positive displacement type such as a scroll type or a rotary type. The compressor 25 compresses a low-pressure refrigerant sucked from a suction pipe 25*b* and then discharges the compressed refrigerant from a discharge pipe 25*a*. The compressor 25 contains refrigerating machine oil. This refrigerating machine oil occasionally circulates in a refrigerant circuit along with the refrigerant. The outdoor unit 110 according to one or more embodiments includes a single compressor 25. The outdoor unit 110 may alternatively include two or more compressors 25 connected in parallel.

The first flow path switching valve 26, the second flow path switching valve 27, and the third flow path switching valve 28 are four-way switching valves. Each of the first flow path switching valve 26, the second flow path switching valve 27, and the third flow path switching valve 28 switches a refrigerant flow in accordance with an operation situation of the air conditioner 101. Each of the first flow path switching valve 26, the second flow path switching valve 27, and the third flow path switching valve 28 has a refrigerant inflow port connected with the discharge pipe 25*a* or a branching pipe extending from the discharge pipe 25*a*. Each of the first flow path switching valve 26, the second flow path switching valve 27, and the third flow path switching valve 28 has a refrigerant inflow port connected with a branching pipe extending from the refrigerant pipe 25*c* connecting the gas-side second shutoff valve 23 and the accumulator 24. Each of the first flow path switching valve 26, the second flow path switching valve 27, and the third flow path switching valve 28 is configured to shut off a refrigerant flow in a refrigerant flow path during operation, and actually functions as a three-way valve.

The outdoor heat exchanger 30 is of a cross-fin type or a microchannel type. The outdoor heat exchanger 30 includes a first heat exchange unit 31 and a second heat exchange unit 32. The first heat exchange unit 31 is provided in an upper portion of the outdoor heat exchanger 30, and the second heat exchange unit 32 is provided below the first heat exchange unit 31.

The first heat exchange unit 31 has a gas side end connected to a refrigerant pipe extending to the third flow path switching valve 28. The first heat exchange unit 31 has a liquid side end connected to a refrigerant pipe extending to the first outdoor expansion valve 34.

The second heat exchange unit 32 has a gas side end connected to a refrigerant pipe extending to the first flow path switching valve 26. The second heat exchange unit 32 has a liquid side end connected to a refrigerant pipe extending to the second outdoor expansion valve 35.

The refrigerant passing the first heat exchange unit 31 and the second heat exchange unit 32 exchanges heat with an air flow generated by the outdoor fan 33. The outdoor fan 33 is a propeller fan or the like, and is driven by an outdoor fan motor (not depicted). The outdoor fan 33 generates an air flow entering the outdoor unit 110, passing the outdoor heat exchanger 30, and flowing out of the outdoor unit 110.

Examples of the first outdoor expansion valve 34 and the second outdoor expansion valve 35 include a motor valve having an adjustable opening degree. The first outdoor expansion valve 34 has a first end connected to a refrigerant pipe extending from the first heat exchange unit 31. The first outdoor expansion valve 34 has a second end connected to a refrigerant pipe extending to the liquid-side shutoff valve 21.

The second outdoor expansion valve 35 has a first end connected to a refrigerant pipe extending from the second heat exchange unit 32. The second outdoor expansion valve 35 has a second end connected to a refrigerant pipe extending to the liquid-side shutoff valve 21. Each of the first outdoor expansion valve 34 and the second outdoor expansion valve 35 has an opening degree adjusted in accordance with an operation situation, and decompresses the refrigerant passing the corresponding outdoor expansion valve in accordance with the opening degree.

Figure 7:
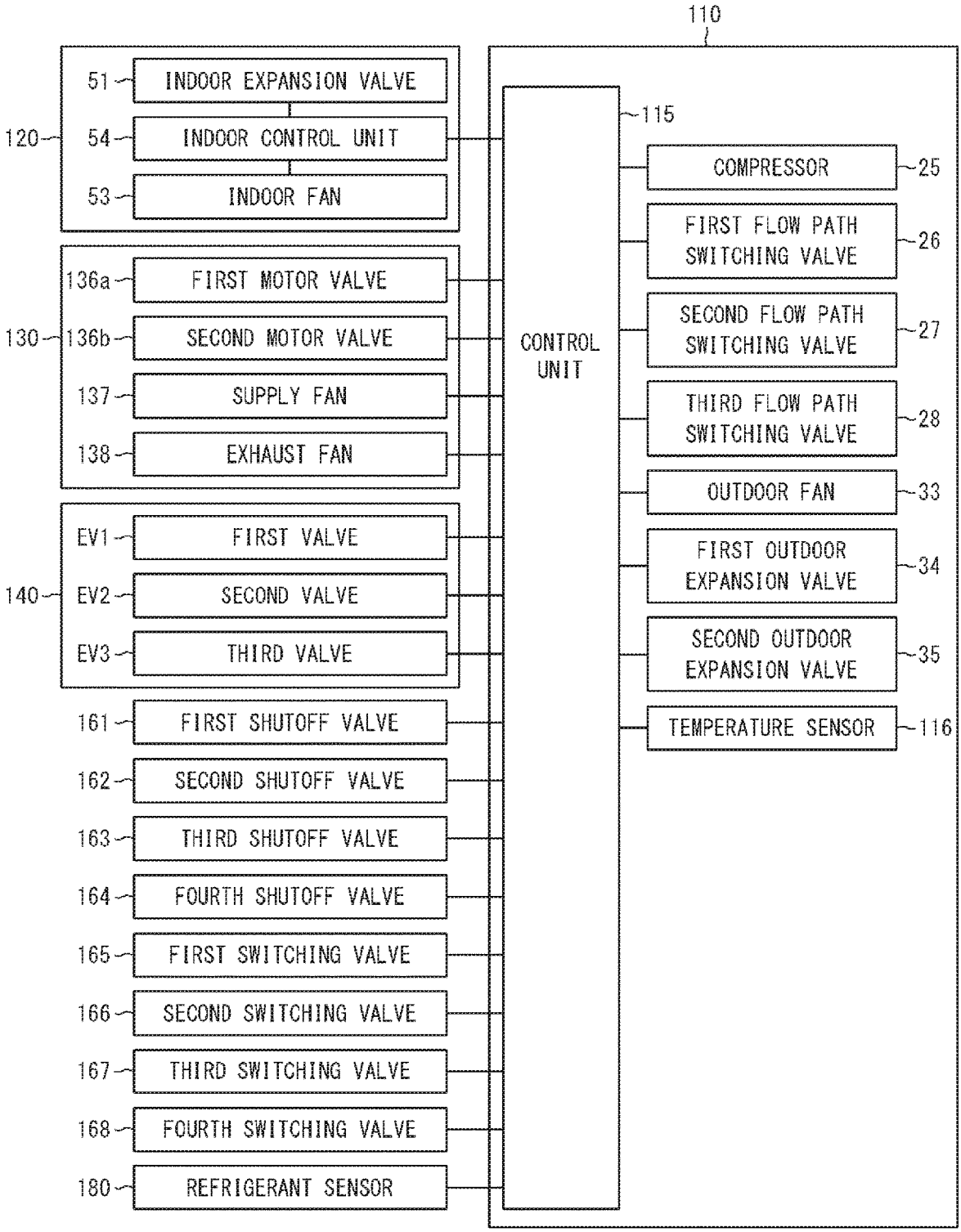
FIG. 7 is a control block diagram of the air conditioning system according to the first embodiments.

The compressor 25, the outdoor fan 33, the first outdoor expansion valve 34, the second outdoor expansion valve 35, the first flow path switching valve 26, the second flow path switching valve 27, and the third flow path switching valve 28 are operation controlled by the control unit 115 (see FIG. 7). The control unit 115 in the outdoor unit 110 transmits and receives signals to and from an indoor control unit 54 (see FIG. 7) in each of the indoor units 120 and a control unit (not depicted) in the refrigerant flow path switching device 140 via communication lines.

[Configuration of Indoor Units]

Each of the indoor units 120 is of a ceiling embedded type, a ceiling pendant type, a floor-standing type, or a wall mounted type. The air conditioning system 100 according to one or more embodiments includes the two or more indoor units 120.

Each of the indoor units 120 is provided therein with a utilization refrigerant circuit RC4. The utilization refrigerant circuit RC4 includes an indoor expansion valve 51 and an indoor heat exchanger 52. The utilization refrigerant circuit RC4 is constituted by the indoor expansion valve 51 and the indoor heat exchanger 52 connected via a refrigerant pipe.

The indoor unit 120 is provided with an indoor fan 53 and the indoor control unit 54 (see FIG. 7). The indoor expansion valve 51 is a motor valve having an adjustable opening degree. The indoor expansion valve 51 has a first end connected to a liquid tube LP. The indoor expansion valve 51 has a second end connected to a refrigerant pipe extending to the indoor heat exchanger 52. The indoor expansion valve 51 decompresses the refrigerant passing therethrough in accordance with the opening degree.

The indoor heat exchanger 52 is of a cross-fin type, a microchannel type, or the like. The indoor heat exchanger 52 has a liquid side end connected to a refrigerant pipe extending from the indoor expansion valve 51. The indoor heat exchanger 52 has a gas side end connected to a gas tube GP. The refrigerant having entered the indoor heat exchanger 52 exchanges heat with an air flow generated by the indoor fan 53 and is exhausted from the indoor heat exchanger 52.

Examples of the indoor fan 53 include a cross-flow fan and a sirocco fan. The indoor fan 53 is driven by an indoor fan motor (not depicted). The indoor fan 53 generates an air flow entering the indoor unit 120 from an indoor space, passing the indoor heat exchanger 52, and then flowing out to the indoor space.

The indoor expansion valve 51 and the indoor fan 53 are operation controlled by the indoor control unit 54 (see FIG. 7) in the indoor unit 120. The indoor control unit 54 is connected with the control unit 115 of the outdoor unit 110 and a remote controller (not depicted). The indoor control unit 54 drives the indoor fan 53 and the indoor expansion valve 51 in accordance with operating conditions such as set temperature inputted to the remote controller.

[Configuration of Refrigerant Flow Path Switching Device]

As depicted in FIG. 1 and FIG. 2, the refrigerant flow path switching device 140 is provided between the outdoor unit 110 and the plurality of indoor units 120. The refrigerant flow path switching device 140 includes a casing 141. The refrigerant flow path switching device 140 switches flows of the refrigerant entering the outdoor unit 110 and the indoor units 120. As depicted in FIG. 2, the casing 141 accommodates a plurality of header pipes 55, 56, 57, and 58 and a plurality of switching units 70.

(Header Pipes)

As depicted in FIG. 2, the plurality of header pipes 55, 56, 57, and 58 includes a first header pipe 55, a second header pipe 56, a third header pipe 57, and a fourth header pipe 58. The first header pipe 55 is connected to the first connection pipe 11. The second header pipe 56 is connected to the second connection pipe 12. The third header pipe 57 is connected to the third connection pipe 13.

(Switching Units)

The refrigerant flow path switching device 140 includes the plurality of switching units 70. The switching units 70 constitute the intermediate refrigerant circuit RC3 of the refrigerant flow path switching device 140. Each of the switching units 70 is connected with a single indoor unit 120. All the switching units 70 of the refrigerant flow path switching device 140 are not necessarily connected with the indoor units 120, and the refrigerant flow path switching device 140 may include a switching unit 70 not connected to any indoor unit 120.

(Regarding Intermediate Refrigerant Circuit)

The plurality of switching units 70 is configured identically, and the intermediate refrigerant circuit RC3 in each of the switching units 70 includes a plurality of valves EV1, EV2, and EV3, and a plurality of refrigerant pipes.

The plurality of valves EV1, EV2, and EV3 in each of the switching units 70 includes a first valve EV1, a second valve EV2, and a third valve EV3. These valves EV1, EV2, and EV3 are each constituted by a motor valve having an adjustable opening degree. Each of the second valve EV2 and the third valve EV3 is operation controlled by a control unit (not depicted) so as to come into a fully closed state, a fully opened state, or an opening degree adjusted state. The first valve EV1 is operation controlled by a control unit (not depicted) so as to come into a minimum opening degree state, the fully opened state, the fully closed state, or the opening degree adjusted state.

The switching units 70 each include a first refrigerant tube P1 connecting the second header pipe 56 and the first valve EV1. The first refrigerant tube P1 has a halfway portion provided with a filter F1. The switching unit 70 includes a second refrigerant tube P2. The second refrigerant tube P2 has a first end connected to the first valve EV1. The switching unit 70 includes a utilization gas pipe 61. The utilization gas pipe 61 has a first end connected to the gas tube GP of the indoor unit 120. The utilization gas pipe 61 has a second end connected to the second valve EV2. The second refrigerant tube P2 has a second end connected to the utilization gas pipe 61. The utilization gas pipe 61 is provided with a filter F2.

The switching unit 70 includes a third refrigerant tube P3. The third refrigerant tube P3 has a first end connected to the second valve EV2. The third refrigerant tube P3 has a second end connected to the third header pipe 57. The third refrigerant tube P3 has a halfway portion provided with a filter F3.

The switching unit 70 includes a utilization liquid pipe 62. The utilization liquid pipe 62 has a first end connected to the liquid tube LP of the indoor unit 120. The utilization liquid pipe 62 has a second end connected to a subcooling heat exchanger 59. The subcooling heat exchanger 59 is provided therein with a first heat transfer tube 59*a* and a second heat transfer tube 59*b*. The subcooling heat exchanger 59 causes heat exchange between the refrigerant flowing in the first heat transfer tube 59*a* and the refrigerant flowing in the second heat transfer tube 59*b*. The utilization liquid pipe 62 has a second end connected to a first end of the first heat transfer tube 59*a*.

The switching unit 70 includes a fourth refrigerant tube P4. The fourth refrigerant tube P4 has a first end connected to a second end of the first heat transfer tube 59*a*. The fourth refrigerant tube P4 has a second end connected to the first header pipe 55.

The switching unit 70 includes a fifth refrigerant tube P5 branching from a halfway portion of the fourth refrigerant tube P4. The fifth refrigerant tube P5 has a first end connected to a first end of the third valve EV3. The fifth refrigerant tube P5 has a halfway portion provided with a filter F4.

The switching unit 70 includes a sixth refrigerant tube P6 and a seventh refrigerant tube P7. The sixth refrigerant tube P6 has a first end connected to the third valve EV3. The sixth refrigerant tube P6 has a second end connected to a first end of the second heat transfer tube 59*b* of the subcooling heat exchanger 59. The seventh refrigerant tube P7 has a first end connected to the second heat transfer tube 59*b* of the subcooling heat exchanger 59. The seventh refrigerant tube P7 has a second end connected to the fourth header pipe 58. The fourth header pipe 58 is connected to the third header pipe 57 via a connecting tube 63.

The fourth header pipe 58 receives the refrigerant flowing from the first header pipe 55 via the fourth refrigerant tube P4, the fifth refrigerant tube P5, the third valve EV3, the sixth refrigerant tube P6, the subcooling heat exchanger 59, and the seventh refrigerant tube P7. The refrigerant having entered the fourth header pipe 58 passes the connecting tube 63 and flows into the third header pipe 57.

[Configuration of First Heat Recovery Unit]

Figure 3:
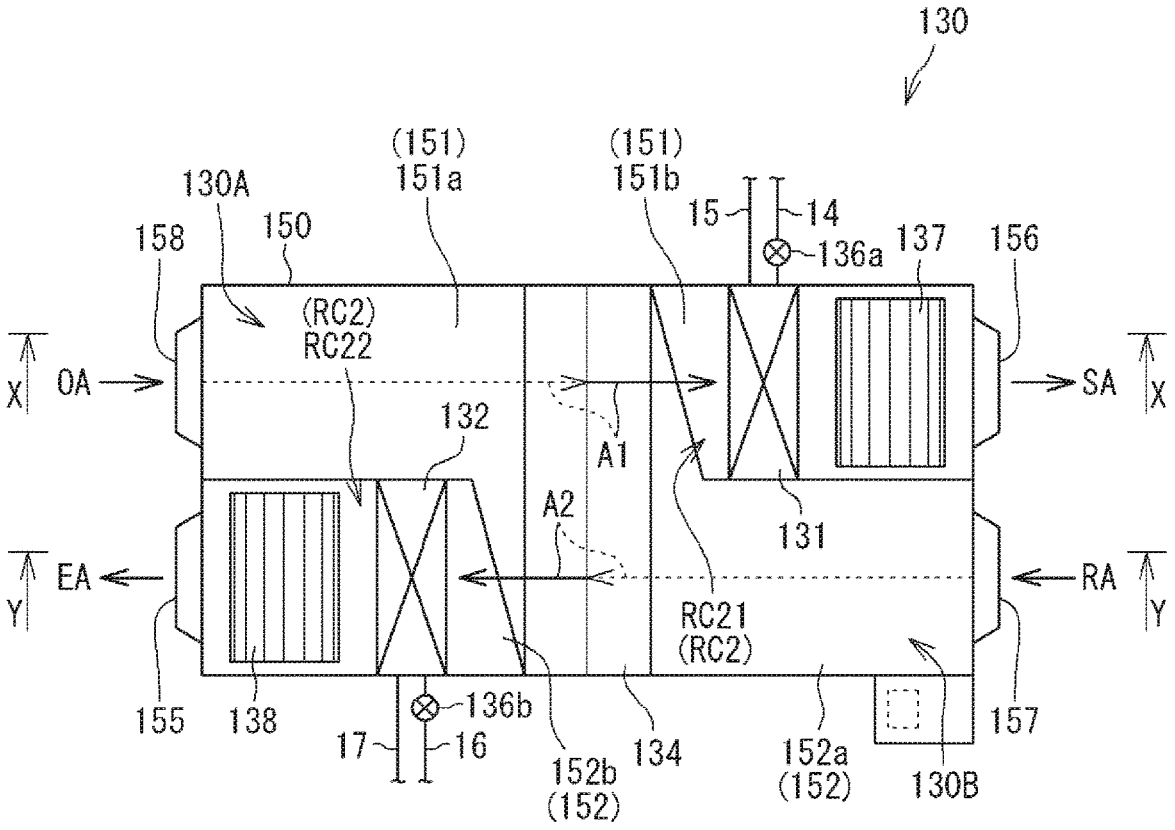
FIG. 3 is a schematic configuration diagram of a heat recovery unit according to the first embodiments.

The first heat recovery unit 130 is configured to supply the indoor space S1 with cooled or heated air (outdoor air) and ventilate the indoor space S1 while recovering heat from air (exhaust air) exhausted from the indoor space S1, and is also referred to as an outdoor air treating unit. The first heat recovery unit 130 is disposed outside the indoor space S1 in the building B. The first heat recovery unit 130 is disposed in a ceiling space above the indoor space S1, and is connected to the indoor space S1 and the outdoor space S2 via ducts. One or more embodiments exemplify the case where the first heat recovery unit 130 is disposed in the ceiling space above the indoor space S1. Alternatively, the first heat recovery unit according to the present disclosure may be of the ceiling pendant type, the ceiling embedded type, the floor-standing type, or the wall mounted type, and may be disposed at a position other than the ceiling space. As depicted in FIG. 2 and FIG. 3, the first heat recovery unit 130 includes an outdoor air treatment unit 130A including the auxiliary refrigerant circuit RC2, and an exhaust air treatment unit 130B. The outdoor air treatment unit 130A includes a supply air auxiliary heat exchanger 131 and a supply fan 137, and the supply air auxiliary heat exchanger 131 constitutes a first auxiliary refrigerant circuit RC21 as part of the auxiliary refrigerant circuit RC2. The exhaust air treatment unit 130B includes an exhaust air auxiliary heat exchanger 132 and an exhaust fan 138, and the exhaust air auxiliary heat exchanger 132 constitutes a second auxiliary refrigerant circuit RC22 as another part of the auxiliary refrigerant circuit RC2.

Each of the supply air auxiliary heat exchanger 131 and the exhaust air auxiliary heat exchanger 132 is of the cross-fin type, the microchannel type, or the like. The supply air auxiliary heat exchanger 131 has a liquid side end connected to the first connection pipe 11 via a first branching pipe 14. The supply air auxiliary heat exchanger 131 has a gas side end connected to the third connection pipe 13 via a second branching pipe 15, or is connected to the second connection pipe 12 via a second branching pipe 15 and a fifth branching pipe 18. The first branching pipe 14 has a halfway portion provided with a first motor valve 136*a*.

The second branching pipe 15 is connected with a first end of the fifth branching pipe 18. The fifth branching pipe 18 has a second end connected to the second connection pipe 12. There is provided a first switching valve 165 at a position closer to the third connection pipe 13 than a connecting position of the fifth branching pipe 18 on the second branching pipe 15. The fifth branching pipe 18 has a halfway portion provided with a second switching valve 166.

The exhaust air auxiliary heat exchanger 132 has a liquid side end connected to the first connection pipe 11 via a third branching pipe 16. The exhaust air auxiliary heat exchanger 132 has a gas side end connected to the third connection pipe 13 via a fourth branching pipe 17, or is connected to the second connection pipe 12 via the fourth branching pipe 17 and a sixth branching pipe 19. The third branching pipe 16 has a halfway portion provided with a second motor valve 136*b*.

The fourth branching pipe 17 is connected with a first end of the sixth branching pipe 19. The sixth branching pipe 19 has a second end connected to the second connection pipe 12. There is provided a third switching valve 167 at a position closer to the third connection pipe 13 than a connecting position of the sixth branching pipe 19 on the fourth branching pipe 17. The sixth branching pipe 19 has a halfway portion provided with a fourth switching valve 168.

The first motor valve 136*a* is configured to control quantity of the refrigerant passing the supply air auxiliary heat exchanger 131. The second motor valve 136*b* is configured to control quantity of the refrigerant passing the exhaust air auxiliary heat exchanger 132. The first motor valve 136*a* and the second motor valve 136*b* each have an adjustable opening degree.

The first auxiliary refrigerant circuit RC21 is connected to the first connection pipe 11 via the first branching pipe 14, is connected to the third connection pipe 13 via the second branching pipe 15, and is connected to the second connection pipe 12 via the second branching pipe 15 and the fifth branching pipe 18. The second auxiliary refrigerant circuit RC22 is connected to the first connection pipe 11 via the third branching pipe 16, is connected to the third connection pipe 13 via the fourth branching pipe 17, and is connected to the second connection pipe 12 via the fourth branching pipe 17 and the sixth branching pipe 19.

(Supply Fan and Exhaust Fan)

The first heat recovery unit 130 is provided therein with the supply fan 137 and the exhaust fan 138. The supply fan 137 constitutes part of the outdoor air treatment unit 130A, and the exhaust fan 138 constitutes part of the exhaust air treatment unit 130B. Examples of the supply fan 137 and the exhaust fan 138 include a sirocco fan. The supply fan 137 is driven by a supply fan motor (not depicted). The supply fan 137 generates an air flow entering the first heat recovery unit 130 from the outdoor space S2 (see FIG. 1), passing the supply air auxiliary heat exchanger 131, and then flowing out to the first space S11 (see FIG. 1). The exhaust fan 138 is driven by an exhaust fan motor (not depicted). The exhaust fan 138 generates an air flow entering the first heat recovery unit 130 from the first space S11 (see FIG. 1), passing the exhaust air auxiliary heat exchanger 132, and then flowing out to the outdoor space S2 (see FIG. 1).

(Supply Air Passage and Exhaust Air Passage)

FIG. 3 depicts a return air intake port 157 provided to import air (return air) RA from the indoor space 51 (see FIG. 1) into a casing 150. The return air intake port 157 is connected to the indoor space 51 via a duct or the like (not depicted). There is provided an exhaust air blow-out port 155 to exhaust, as exhaust air EA, the return air RA imported into the casing 150, to the outdoor space S2 (see FIG. 1). The exhaust air blow-out port 155 is connected to the outdoor space S2 via a duct or the like (not depicted). There is provided an outdoor air intake port 158 to import air (outdoor air) OA from the outdoor space S2 into the casing 150. The outdoor air intake port 158 is connected to the outdoor space S2 via a duct or the like (not depicted). There is provided a supply air blow-out port 156 to supply the indoor space S1 with the outdoor air OA imported into the casing 150 as supply air SA. The supply air blow-out port 156 is connected to the indoor space S1 via a duct or the like (not depicted).

(Heat Exchange Unit)

Figure 4:
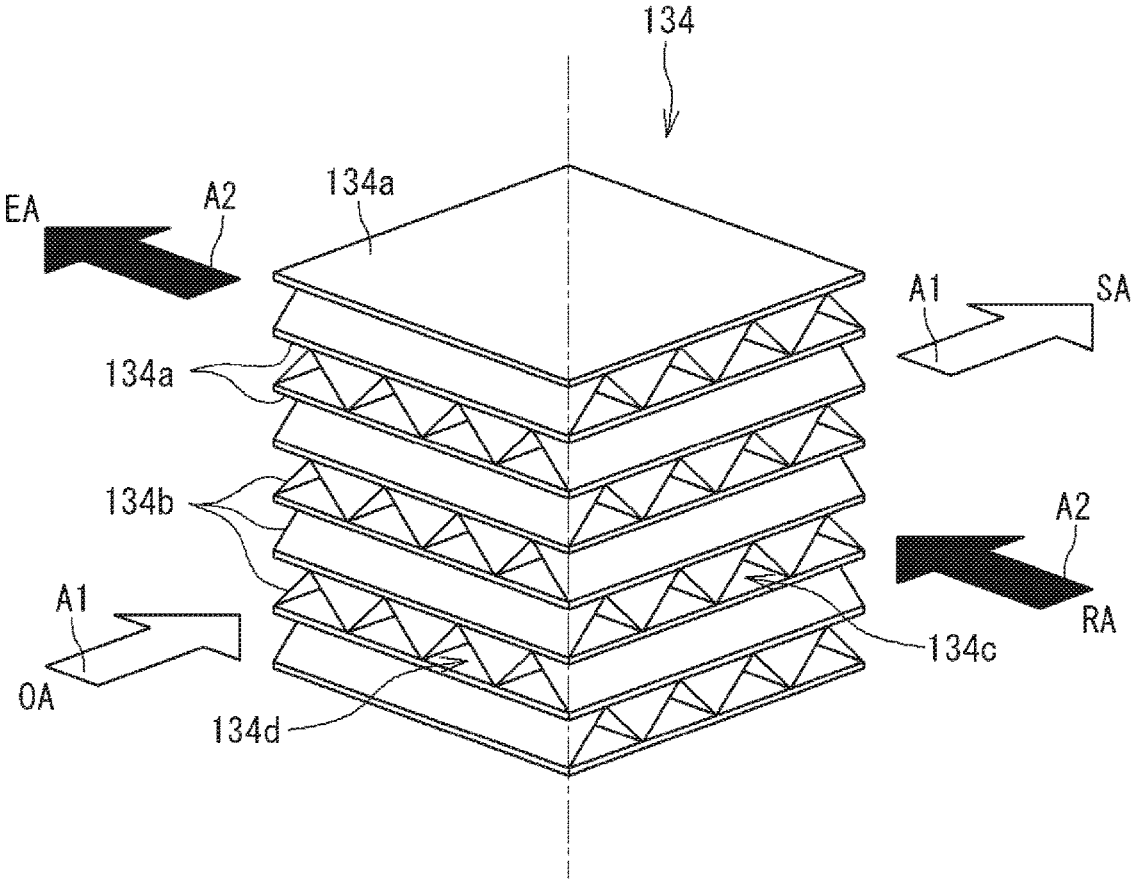
FIG. 4 is a perspective view of a heat exchange unit.

FIG. 4 is a perspective view of a heat exchange unit. FIG. 4 depicts a heat exchange unit 134 according to one or more embodiments, as a perpendicular total heat exchanger configured to have a first air flow A1 and a second air flow A2 running substantially perpendicularly to each other. The heat exchange unit 134 includes partition plates 134*a* and partition wall plates 134*b*. The partition plates 134*a* and the partition wall plates 134*b* are alternately stacked with use of an appropriate adhesive. The heat exchange unit 134 entirely has a substantially quadrangular prism shape.

Each of the partition plates 134*a* has a heat transfer property and moisture permeability, and is formed into a flat plate shape. Each of the partition wall plates 134*b* is formed into a corrugated plate shape continuously having substantially triangular sections. Each of the partition wall plates 134*b* forms an air passage between two of the partition plates 134*a* adjacent to each other. The partition wall plates 134*b* are stacked so as to be turned by 90 degrees one by one in a stacking direction (a vertical direction in FIG. 4) of the partition plates 134*a* and the partition wall plates 134*b*. There are thus provided a supply air passage 134*d* for the first air flow A1 and an exhaust air passage 134*c* for the second air flow A2. The supply air passage 134*d* and the exhaust air passage 134*c* interpose a single partition plate 134*a*, and are disposed perpendicularly to each other. Air flowing in the exhaust air passage 134*c* and air flowing in the supply air passage 134*d* are to exchange sensible heat and latent heat (total heat exchange) via the partition plate 134*a* having the heat transfer property and the moisture permeability. In the air conditioning system 100, the first heat recovery unit 130 recovers heat with use of the refrigerant flowing in the first auxiliary refrigerant circuit RC21 and the heat exchange unit 134 further recovers heat between air flows (the return air RA and the outdoor air OA) in the casing 150, to achieve better operation efficiency of the air conditioner 101.

Figure 5:
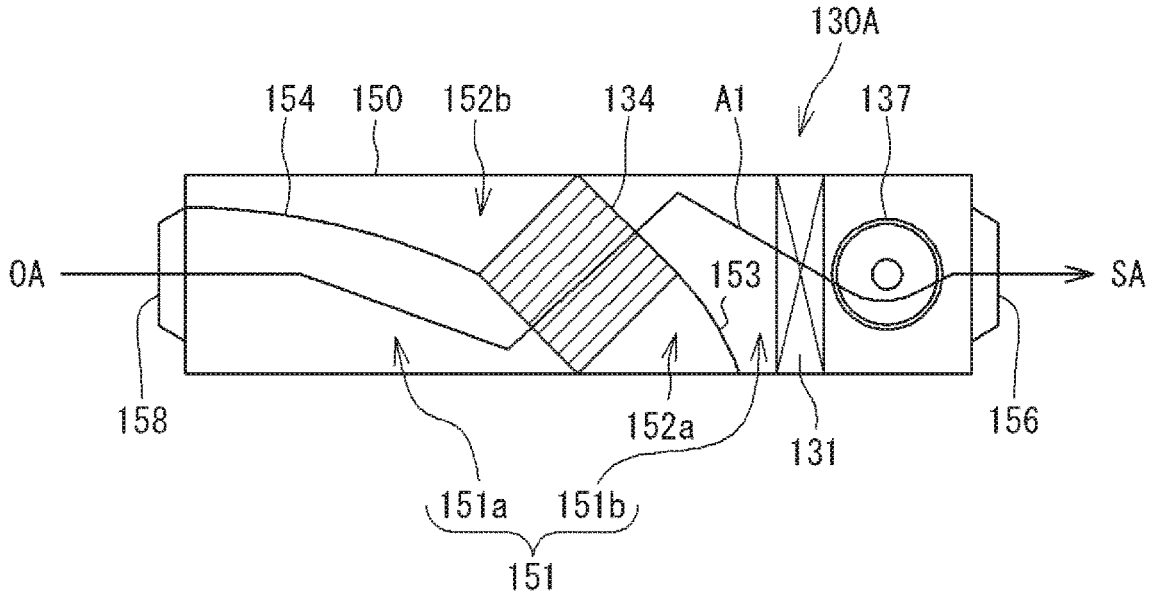
FIG. 5 is a schematic explanatory sectional view taken along line X-X indicated in FIG. 3.
Figure 6:
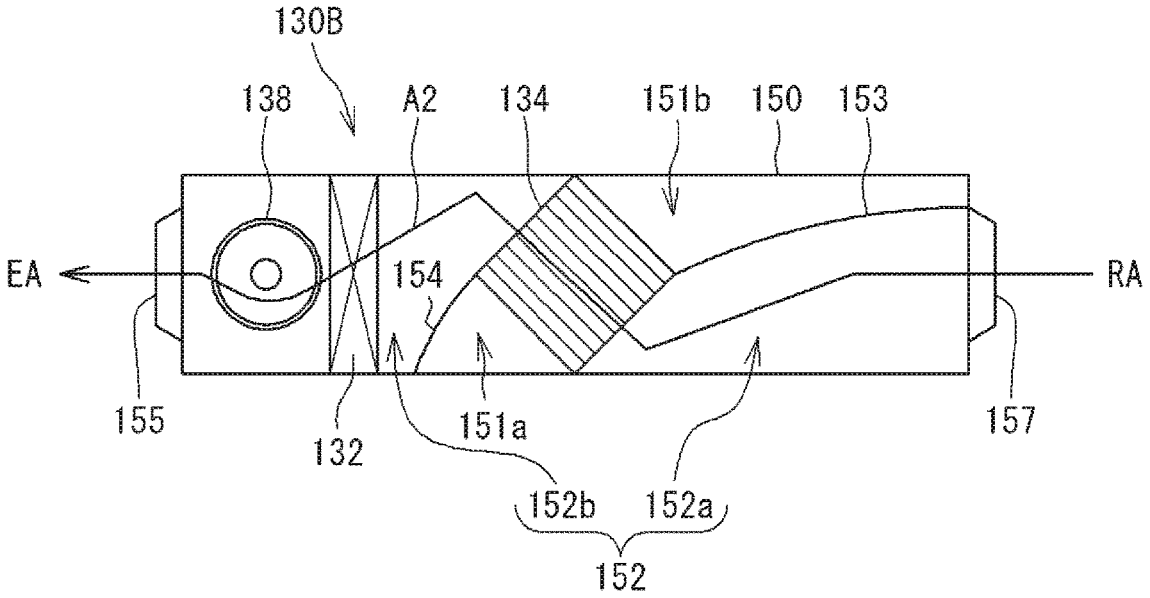
FIG. 6 is a schematic explanatory sectional view taken along line Y-Y indicated in FIG. 3.

FIG. 5 is a schematic explanatory sectional view taken along line X-X indicated in FIG. 3. FIG. 6 is a schematic explanatory sectional view taken along line Y-Y indicated in FIG. 3. As depicted in FIG. 3, FIG. 5, and FIG. 6, the first heat recovery unit 130 includes the casing 150. The casing 150 has the interior sectioned by the heat exchange unit 134 into two regions, specifically, a region adjacent to the indoor space S1 and a region adjacent to the outdoor space S2. As depicted in FIG. 5, the casing 150 is provided therein with an upstream supply air passage 151*a* disposed upstream of the heat exchange unit 134 on the first air flow A1, and a downstream supply air passage 151*b* disposed downstream of the heat exchange unit 134 on the first air flow A1. The upstream supply air passage 151*a* and the downstream supply air passage 151*b* constitute a supply air passage 151 causing the indoor space 51 and the outdoor space S2 to communicate with each other via the heat exchange unit 134.

As depicted in FIG. 6, the casing 150 is provided therein with an upstream exhaust air passage 152*a* disposed upstream of the heat exchange unit 134 on the second air flow A2, and a downstream exhaust air passage 152*b* disposed downstream of the heat exchange unit 134 on the second air flow A2. The upstream exhaust air passage 152*a* and the downstream exhaust air passage 152*b* constitute an exhaust air passage 152 causing the indoor space S1 and the outdoor space S2 to communicate with each other via the heat exchange unit 134.

As depicted in FIG. 5 and FIG. 6, the downstream supply air passage 151*b* and the upstream exhaust air passage 152*a* interpose a sectioning wall 153. The upstream supply air passage 151*a* and the downstream exhaust air passage 152*b* interpose a sectioning wall 154.

As depicted in FIG. 5, the downstream supply air passage 151*b* is provided, adjacent to the supply air blow-out port 156, with the supply fan 137 and the supply air auxiliary heat exchanger 131. The supply fan 137 operates to generate the first air flow A1, and the outdoor air OA in the outdoor space S2 passes the supply air passage 151 to exchange heat in the supply air auxiliary heat exchanger 131 and be supplied into the indoor space S1 as the supply air SA. As depicted in FIG. 2 and FIG. 3, the supply air auxiliary heat exchanger 131 causes heat exchange (heat recovery) between the refrigerant flowing in the first auxiliary refrigerant circuit RC21 and air (the outdoor air OA) passing the supply air passage 151.

As depicted in FIG. 6, the downstream exhaust air passage 152*b* is provided, adjacent to the exhaust air blow-out port 155, with the exhaust fan 138 and the exhaust air auxiliary heat exchanger 132. The exhaust fan 138 operates to generate the second air flow A2, and the return air RA from the indoor space S1 passes the exhaust air passage 152 to exchange heat in the exhaust air auxiliary heat exchanger 132 and be exhausted as the exhaust air EA to the outdoor space S2. As depicted in FIG. 2 and FIG. 3, the exhaust air auxiliary heat exchanger 132 causes heat exchange (heat recovery) between the refrigerant flowing in the second auxiliary refrigerant circuit RC22 and air (the exhaust air EA) passing the exhaust air passage 152.

As described above, the first heat recovery unit 130 includes the casing 150 accommodating the first auxiliary refrigerant circuit RC21, the second auxiliary refrigerant circuit RC22, the supply fan 137, and the exhaust fan 138, and provided with the supply air passage 151 for air passing the supply air auxiliary heat exchanger 131 and the exhaust air passage 152 for air passing the exhaust air auxiliary heat exchanger 132, and the heat exchange unit 134 configured to cause heat exchange between air existing in the supply air passage 151 and being subject to passing the supply air auxiliary heat exchanger 131 and air existing in the exhaust air passage 152 and being subject to passing the exhaust air auxiliary heat exchanger 132. In the air conditioning system 100, the single casing 150 accommodates the outdoor air treatment unit 130A and the exhaust air treatment unit 130B in the first heat recovery unit 130, and the heat exchange unit 134, to simplify a pipe configuration around the outdoor air treatment unit 130A and the exhaust air treatment unit 130B. This facilitates connecting work for the heat source refrigerant circuit RC1, the first auxiliary refrigerant circuit RC21, and the second auxiliary refrigerant circuit RC22. One or more embodiments exemplify the first heat recovery unit 130 including the outdoor air treatment unit 130A and the exhaust air treatment unit 130B. Alternatively, the heat recovery unit according to the present disclosure may include only the outdoor air treatment unit 130A. One or more embodiments exemplify the first heat recovery unit 130 including the single casing 150 accommodating the outdoor air treatment unit 130A and the exhaust air treatment unit 130B. Alternatively, in the heat recovery unit according to the present disclosure, the outdoor air treatment unit and the exhaust air treatment unit may be separated from each other to be disposed at different positions.

[Regarding Control Unit]

FIG. 7 is a control block diagram of the air conditioning system 100. As depicted in FIG. 7, the air conditioning system 100 includes the control unit 115. The control unit 115 is configured to control behavior of the air conditioner 101 and the refrigerant flow path switching device 140, and is exemplarily constituted by a microcomputer including a processor such as a CPU and a memory such as a RAM or a ROM. The control unit 115 may alternatively be embodied as hardware with use of an LSI, an ASIC, an FPGA, or the like. The control unit 115 exerts a predetermined function when the processor executes a program installed in the memory. The control unit 115 may be provided integrally with the air conditioner 101 as part of the air conditioner 101, or may be provided separately from the air conditioner 101 as a separate device.

The control unit 115 according to one or more embodiments is provided in the outdoor unit 110. The control unit 115 is connected with the compressor 25, the first flow path switching valve 26, the second flow path switching valve 27, the third flow path switching valve 28, the outdoor fan 33, the first outdoor expansion valve 34, the second outdoor expansion valve 35, and a temperature sensor 116, which are incorporated in the outdoor unit 110. The control unit 115 is connected with the indoor expansion valve 51 and the indoor fan 53 via the indoor control unit 54 in the indoor unit 120. The control unit 115 is connected with the first and second motor valves 136*a* and 136*b*, the supply fan 137, and the exhaust fan 138 of the first heat recovery unit 130. The control unit 115 may alternatively be connected to an auxiliary heat exchanger switching valve 133, the motor valves 136*a* and 136*b*, the supply fan 137, and the exhaust fan 138 via a control unit (not depicted) of the first heat recovery unit 130. The control unit 115 is connected with the first valve EV1, the second valve EV2, and the third valve EV3 via the control unit (not depicted) of the refrigerant flow path switching device 140 (the switching unit 70). The control unit 115 is connected with first to fourth shutoff valves 161 to 164, the first switching valve 165, and the second switching valve 166. The control unit 115 is connected with the temperature sensor 116 and a refrigerant sensor 180. The control unit 115 controls behavior of the above connected constituents in accordance with an operation situation of the air conditioning system 100.

[Regarding Shutoff Valves]

As depicted in FIGS. 1 and 2, the air conditioning system 100 includes the four shutoff valves 161 to 164. The first to fourth shutoff valves 161 to 164 are configured as motor valves. The first shutoff valve 161 is disposed on the first branching pipe 14, the second shutoff valve 162 is disposed on the second branching pipe 15, the third shutoff valve 163 is disposed on the third branching pipe 16, and the fourth shutoff valve 164 is disposed on the fourth branching pipe 17.

In the air conditioning system 100, the refrigerant sensor 180 (see FIG. 7) is disposed at a position enabling sensing of any refrigerant leaking from the first heat recovery unit 130. When the refrigerant sensor 180 senses any refrigerant, the control unit 115 operates all the shutoff valves 161 to 164. When all the shutoff valves 161 to 164 operate in the air conditioning system 100, the auxiliary refrigerant circuit RC2 (the first auxiliary refrigerant circuit RC21 and the second auxiliary refrigerant circuit RC22) of the first heat recovery unit 130 is completely separated from the remaining refrigerant circuits RC1, RC3, and RC4. Even if the refrigerant (R32 in one or more embodiments) having combustibility leaks from the first heat recovery unit 130, the air conditioning system 100 can thus inhibit leakage from the first heat recovery unit 130 of the refrigerant having quantity exceeding the refrigerant being stored in the auxiliary refrigerant circuit RC2. The refrigerant sensor 180 may alternatively be provided on each of the supply air passage 151 and the exhaust air passage 152. In this configuration, only the shutoff valves 161 and 162 adjacent to the supply air passage 151 may be shut off when the refrigerant sensor 180 on the supply air passage 151 senses any refrigerant, and only the shutoff valves 163 and 164 adjacent to the exhaust air passage 152 may be shut off when the refrigerant sensor 180 on the exhaust air passage 152 senses any refrigerant.

[Operation of Air Conditioning System]

With reference to FIG. 2, description is made hereinafter to a case where all the indoor units 120 in operation in the air conditioning system 100 execute cooling operation (hereinafter, also referred to as "full cooling operation"), a case where all the indoor units 120 in operation execute heating operation (hereinafter, also referred to as "full heating operation), a case where some of the indoor units 120 in operation execute cooling operation and the remaining ones execute heating operation (hereinafter, also referred to as "cooling and heating mixed operation"), and a case where outdoor air cooling operation is executed with use of the first heat recovery unit 130 (hereinafter, also referred to as "outdoor air cooling operation").

(Full Cooling Operation)

During full cooling operation, the control unit 115 adjusts the valves as follows. In the switching unit 70, the first valve EV1 is fully closed, the second valve EV2 is fully opened, and the third valve EV3 is adjusted in opening degree. The indoor expansion valve 51 is adjusted in opening degree, and the first and second outdoor expansion valves 34 and 35 are fully opened. The shutoff valves 161 to 164 are fully opened, and the first motor valve 136*a* and the second motor valve 136*b* are adjusted in opening degree. The first flow path switching valve 26 in the outdoor unit 110 is switched to connect the discharge pipe 25*a* of the compressor 25 and the gas side end of the second heat exchange unit 32. The second flow path switching valve 27 is switched to connect the discharge pipe 25*a* and the second connection pipe 12. The third flow path switching valve 28 is switched to connect the discharge pipe 25*a* and the gas side end of the first heat exchange unit 31. Alternatively, the air conditioning system 100 according to the present disclosure may not include the second flow path switching valve 27 because a high-pressure gas refrigerant may constantly flow in the second connection pipe 12. In the case where the second flow path switching valve 27 is provided, the second flow path switching valve 27 is switched when the first valve EV1 connected to the second connection pipe 12 has the minimum opening degree and the high-pressure gas refrigerant does not need to flow in the second connection pipe 12, to prevent refrigerant accumulation between the first valve EV1 and the second flow path switching valve 27.

In the indoor unit 120 being stopped, during any one of full cooling operation, full heating operation, and cooling and heating mixed operation, the control unit 115 causes the indoor expansion valve 51 to be fully closed, causes the first valve EV1 corresponding to this indoor unit 120 to have the minimum opening degree, and causes the second valve EV2 and the third valve EV3 to be fully closed.

When the compressor 25 is driven, a high-pressure gas refrigerant compressed by the compressor 25 passes the discharge pipe 25*a*, the first flow path switching valve 26, the third flow path switching valve 28, and the like, and then flows into the outdoor heat exchanger 30 to be condensed. The refrigerant condensed in the outdoor heat exchanger 30 passes the first and second outdoor expansion valves 34 and 35, the liquid-side shutoff valve 21, and the like, to flow into the first connection pipe 11.

The refrigerant having entered the first connection pipe 11 flows in the first header pipe 55 of the refrigerant flow path switching device 140, and flows into the fourth refrigerant tube P4 of each of the switching units 70. The refrigerant having entered the fourth refrigerant tube P4 flows into the first heat transfer tube 59*a* of the subcooling heat exchanger 59, and then passes the utilization liquid pipe 62 to flow into the indoor unit 120.

The refrigerant having entered the fourth refrigerant tube P4 also branches into the fifth refrigerant tube P5, is decompressed in accordance with the opening degree of the third valve EV3, and flows into the second heat transfer tube 59*b* of the subcooling heat exchanger 59. The refrigerant flowing in the first heat transfer tube 59*a* and the refrigerant flowing in the second heat transfer tube 59*b* exchange heat with each other in the subcooling heat exchanger 59, and the refrigerant flowing in the first heat transfer tube 59*a* is subcooled and flows into the indoor unit 120.

The refrigerant flowing in the second heat transfer tube 59*b* of the subcooling heat exchanger 59 flows from the seventh refrigerant tube P7 into the fourth header pipe 58, passes the connecting tube 63, and flows into the third header pipe 57. The refrigerant having entered the indoor unit 120 is decompressed at the indoor expansion valve 51 and is then evaporated in the indoor heat exchanger 52.

In the indoor unit 120, the refrigerant evaporated in the indoor heat exchanger 52 flows from the gas tube GP into the utilization gas pipe 61, mainly passes the second valve EV2 and flows into the third header pipe 57. The refrigerant having entered the third header pipe 57 passes the third connection pipe 13 and the gas-side second shutoff valve 23, and then flows into the accumulator 24 to be sucked in to the compressor 25.

(Regarding Processing by First Heat Recovery Unit During Full Cooling Operation)

With reference to FIG. 2, description is made to processing by the first heat recovery unit 130 during full cooling operation. While the air conditioning system 100 is executing cooling operation, the first switching valve 165 is opened whereas the second switching valve 166 is closed. The supply air auxiliary heat exchanger 131 is thus supplied with a liquid refrigerant from the first connection pipe 11 and the first branching pipe 14, and the liquid refrigerant flows into the supply air auxiliary heat exchanger 131. The liquid refrigerant exchanges heat with air (the outdoor air OA) in the supply air auxiliary heat exchanger 131 to be evaporated into a low-pressure gas refrigerant. The gas refrigerant flows from the second branching pipe 15 into the third connection pipe 13. The first heat recovery unit 130 cools the outdoor air OA in this manner during cooling operation, and supplies the first space S11 with the supply air SA.

While the air conditioning system 100 is executing cooling operation, the third switching valve 167 is closed whereas the fourth switching valve 168 is opened. The exhaust air auxiliary heat exchanger 132 in the first heat recovery unit 130 is thus supplied with a high-pressure gas refrigerant from the second connection pipe 12, the sixth branching pipe 19, and the fourth branching pipe 17, and the gas refrigerant flows into the exhaust air auxiliary heat exchanger 132. The gas refrigerant exchanges heat with air (the exhaust air EA) in the exhaust air auxiliary heat exchanger 132 to be condensed into a liquid refrigerant. The liquid refrigerant flows from the third branching pipe 16 into the first connection pipe 11. In this manner, the first heat recovery unit 130 recovers heat from the return air RA as well as discharges the exhaust air EA to the outdoor space S2 during cooling operation. A high-pressure gas refrigerant flowing to the second connection pipe 12 via the second flow path switching valve 27 does not flow into the indoor unit 120 because the first valve EV1 is fully closed.

(Regarding Full Heating Operation)

During full heating operation, the control unit 115 adjusts the valves as follows. In the switching unit 70, the first valve EV1 is fully opened, the second valve EV2 is fully closed, and the third valve EV3 is fully closed. The indoor expansion valve 51 is fully opened, and the first and second outdoor expansion valves 34 and 35 are adjusted in opening degree. The shutoff valves 161 to 164 are fully opened, and the first motor valve 136*a* and the second motor valve 136*b* are adjusted in opening degree. The first flow path switching valve 26 in the outdoor unit 110 is switched to connect the refrigerant pipe 25*c* and the gas side end of the second heat exchange unit 32. The second flow path switching valve 27 is switched to connect the discharge pipe 25*a* and the second connection pipe 12. The third flow path switching valve 28 is switched to connect the refrigerant pipe 25*c* and the gas side end of the first heat exchange unit 31.

When the compressor 25 is driven, the high-pressure gas refrigerant compressed by the compressor 25 passes the discharge pipe 25*a*, the second flow path switching valve 27, and the like, and then flows into the second connection pipe 12. The refrigerant having entered the second connection pipe 12 passes the first valve EV1 via the second header pipe 56 of the refrigerant flow path switching device 140 and the first refrigerant tube P1 of the switching unit 70, and flows from the utilization gas pipe 61 into the gas tube GP of the indoor unit 120.

The refrigerant having entered the gas tube GP flows into the indoor heat exchanger 52 of the indoor unit 120 to be condensed. The condensed refrigerant passes the indoor expansion valve 51, flows in the liquid tube LP, and flows into the utilization liquid pipe 62 of the switching unit 70. The refrigerant having entered the utilization liquid pipe 62 passes the subcooling heat exchanger 59 and the fourth refrigerant tube P4, and flows into the first header pipe 55.

The refrigerant having entered the first header pipe 55 flows in the first connection pipe 11, flows into the outdoor unit 110, and is decompressed at the first and second outdoor expansion valves 34 and 35. The decompressed refrigerant is evaporated while passing the outdoor heat exchanger 30, passes the first flow path switching valve 26, the third flow path switching valve 28, and the like, then flows into the accumulator 24, and is sucked into the compressor 25.

(Regarding Processing by First Heat Recovery Unit During Full Heating Operation)

With reference to FIG. 2, description is made to processing by the first heat recovery unit 130 during full heating operation. While the air conditioning system 100 is executing heating operation, the first switching valve 165 is closed, the second switching valve 166 is opened, the third switching valve 167 is opened, and the fourth switching valve 168 is closed. The supply air auxiliary heat exchanger 131 is thus supplied with a high-pressure gas refrigerant from the second connection pipe 12, the fifth branching pipe 18, and the second branching pipe 15, and the gas refrigerant flows into the supply air auxiliary heat exchanger 131. The gas refrigerant exchanges heat with air (the outdoor air OA) in the supply air auxiliary heat exchanger 131 to be condensed into a liquid refrigerant. The liquid refrigerant flows from the first branching pipe 14 into the first connection pipe 11. The first heat recovery unit 130 heats the outdoor air OA in this manner during heating operation, and supplies the first space S11 with the supply air SA.

The exhaust air auxiliary heat exchanger 132 of the first heat recovery unit 130 is supplied with a liquid refrigerant from the first connection pipe 11 and the third branching pipe 16, and the liquid refrigerant flows into the exhaust air auxiliary heat exchanger 132. The liquid refrigerant exchanges heat with air (the exhaust air EA) in the exhaust air auxiliary heat exchanger 132 to be evaporated into a gas refrigerant. The gas refrigerant flows from the fourth branching pipe 17 into the third connection pipe 13. In this manner, the first heat recovery unit 130 recovers heat from the return air RA as well as discharges the exhaust air EA to the outdoor space S2 during heating operation.

(Regarding Cooling and Heating Mixed Operation)

During cooling and heating mixed operation, the control unit 115 adjusts the valves as follows. In the switching unit 70 (hereinafter, also referred to as a "cooling switching unit 70") corresponding to the indoor unit 120 (hereinafter, also referred to as a "cooling indoor unit 120") executing cooling operation among the indoor units 120 in operation, the first valve EV1 has the minimum opening degree, the second valve EV2 is fully opened, the third valve EV3 is adjusted in opening degree, and the indoor expansion valve 51 in the cooling indoor unit 120 is adjusted in opening degree. The shutoff valves 161 to 164 are fully opened, and the first motor valve 136*a* and the second motor valve 136*b* are adjusted in opening degree. The first flow path switching valve 26 in the outdoor unit 110 is switched to connect the refrigerant pipe 25*c* and the gas side end of the second heat exchange unit 32. The second flow path switching valve 27 is switched to connect the discharge pipe 25*a* and the second connection pipe 12. The third flow path switching valve 28 is switched to connect the discharge pipe 25*a* and the gas side end of the first heat exchange unit 31.

In the switching unit 70 (hereinafter, also referred to as a "heating switching unit 70") corresponding to the indoor unit 120 (hereinafter, also referred to as a "heating indoor unit 120") executing heating operation among the indoor units 120 in operation, the first valve EV1 is fully opened, the second valve EV2 is fully closed, the third valve EV3 is fully closed, the indoor expansion valve 51 in the heating indoor unit 120 is fully opened, and the first outdoor expansion valve 34 and the second outdoor expansion valve 35 are adjusted in opening degree. According to one or more embodiments, the indoor unit 120 (the cooling indoor unit 120) in the first space S11 executes cooling operation whereas the indoor unit 120 (the heating indoor unit 120) in the second space S12 executes heating operation. In this case, in the first heat recovery unit 130 provided for the first space S11, the supply air auxiliary heat exchanger 131 functions as an evaporator correspondingly to the cooling indoor unit 120 in the first space S11, and the exhaust air auxiliary heat exchanger 132 functions as a condenser.

When the compressor 25 is driven, part of the high-pressure gas refrigerant compressed by the compressor 25 passes the discharge pipe 25*a* and the second flow path switching valve 27, and then flows into the second connection pipe 12. Another part of the high-pressure gas refrigerant compressed by the compressor 25 passes the discharge pipe 25*a* and the third flow path switching valve 28, is condensed in the first heat exchange unit 31 of the outdoor heat exchanger 30, and passes the first outdoor expansion valve 34, and part thereof flows into the first connection pipe 11 whereas another part thereof flows into the second outdoor expansion valve 35. The refrigerant condensed in the first heat exchange unit 31 passes the second outdoor expansion valve 35, is evaporated in the second heat exchange unit 32, passes the first flow path switching valve 26, and is sucked into the compressor 25. During cooling and heating mixed operation, how to use the second heat exchange unit 32 varies in accordance with balance between quantity of a condensed refrigerant and quantity of an evaporated refrigerant in the indoor unit 120 and the first heat recovery unit 130. During cooling and heating mixed operation, both the first heat exchange unit 31 and the second heat exchange unit 32 may function as a condenser or an evaporator in accordance with the balance between quantity of the condensed refrigerant and quantity of the evaporated refrigerant in the indoor unit 120 and the first heat recovery unit 130.

The refrigerant having entered the second connection pipe 12 flows into the second header pipe 56 of the refrigerant flow path switching device 140, flows in the first refrigerant tube P1, the first valve EV1, and the utilization gas pipe 61 of the heating switching unit 70, and flows into the gas tube GP.

The refrigerant having entered the gas tube GP is condensed in the indoor heat exchanger 52 of the heating indoor unit 120. The condensed refrigerant flows from the liquid tube LP into the utilization liquid pipe 62 of the heating switching unit 70, flows in the subcooling heat exchanger 59 and the fourth refrigerant tube P4, and flows into the first header pipe 55.

The refrigerant having entered the first connection pipe 11 from the outdoor unit 110 also flows into the first header pipe 55. The refrigerant having entered the first header pipe 55 passes the fourth refrigerant tube P4 of the cooling switching unit 70, the subcooling heat exchanger 59, the utilization liquid pipe 62, and the liquid tube LP, and flows into the cooling indoor unit 120. The refrigerant having passed the subcooling heat exchanger 59 is subcooled by the refrigerant that flowed in the fifth refrigerant tube P5 branched from the fourth refrigerant tube P4, and that decompressed at the third valve EV3.

The refrigerant having entered the cooling indoor unit 120 is decompressed at the indoor expansion valve 51, and is evaporated in the indoor heat exchanger 52 to cool the indoor space. The evaporated refrigerant flows in the gas tube GP, flows into the utilization gas pipe 61 of the cooling switching unit 70, passes the second valve EV2, flows into the third refrigerant tube P3 and the third header pipe 57, flows in the third connection pipe 13, and flows into the accumulator 24 to be sucked into the compressor 25.

In the first heat recovery unit 130, the supply air auxiliary heat exchanger 131 functions as an evaporator correspondingly to the cooling indoor unit 120 in the first space S11, cools the outdoor air OA, and supplies the first space S11 with the supply air SA. In the first heat recovery unit 130, the exhaust air auxiliary heat exchanger 132 functions as a condenser, recovers heat from the return air RA to evaporate a gas refrigerant, and discharges the return air RA increased in temperature as the exhaust air EA to the outdoor space S2.

(Regarding Outdoor Air Cooling Operation)

In the air conditioning system 100, the outdoor unit 110 is provided with the temperature sensor 116 (see FIG. 7). The temperature sensor 116 measures air temperature (outdoor air temperature T) in the outdoor space S2. The temperature sensor 116 may be disposed in the outdoor space S2 other than the outdoor unit 110. The control unit 115 determines that outdoor air cooling operation is executable for the indoor space S1 when the outdoor air temperature T is less than predetermined set temperature TS. The set temperature TS is preliminarily stored in the control unit 115. The set temperature TS can be changed by operating the control unit 115.

With reference to FIG. 2, description is made herein to a case where the indoor unit 120 continuously executes cooling operation in the second space S12 and outdoor air cooling operation for the first space S11 is executed with use of the first heat recovery unit 130. When the control unit 115 determines that outdoor air cooling operation is executable, the air conditioning system 100 switches behavior of the respective constituents as follows.

Specifically, when the outdoor air temperature T is less than the set temperature TS while the first space S11 is cooled, the control unit 115 in the air conditioning system 100 stops the indoor unit 120 and causes the first heat recovery unit 130 to continuously ventilate. Furthermore, the control unit 115 closes the first shutoff valve 161 and the second shutoff valve 162, and operates the supply fan 137. This leads to switching an air conditioning mode for the first space S11 from normal cooling operation to outdoor air cooling operation.

During outdoor air cooling operation, the air conditioning system 100 shuts off the refrigerant passing the supply air auxiliary heat exchanger 131. During outdoor air cooling operation, the air conditioning system 100 can thus operate only the supply fan 137 without heat exchange by the supply air auxiliary heat exchanger 131, for efficient operation of the air conditioning system 100. One or more embodiments exemplify the case where the air conditioning system 100 automatically executes outdoor air cooling operation in accordance with a measurement value of the outdoor air temperature T. Alternatively, the air conditioning system according to the present disclosure may be configured to manually switch to outdoor air cooling operation in accordance with a user command.

Furthermore, during outdoor air cooling operation of the air conditioning system 100, the control unit 115 keeps the third shutoff valve 163 and the fourth shutoff valve 164 "opened" to continue refrigerant supply to the exhaust air auxiliary heat exchanger 132.

The exhaust air auxiliary heat exchanger 132 in the first heat recovery unit 130 is supplied with a high-pressure gas refrigerant from the second connection pipe 12 and the fourth branching pipe 17, and the gas refrigerant flows into the exhaust air auxiliary heat exchanger 132. The gas refrigerant exchanges heat with air (the exhaust air EA) in the exhaust air auxiliary heat exchanger 132 to be condensed into a liquid refrigerant. The liquid refrigerant flows from the third branching pipe 16 into the first connection pipe 11. In this manner, the first heat recovery unit 130 can continuously recover heat from the return air RA during outdoor air cooling operation.

The air conditioning system 100 is configured to execute outdoor air cooling operation for the first space S11, and further recover heat from the exhaust air EA of the first space S11 with use of the exhaust air auxiliary heat exchanger 132. This enables further efficient operation of the air conditioning system 100. Provision of the fourth shutoff valve 164 may suppress in quantity of the refrigerant leaking from the first heat recovery unit 130. Alternatively, the fourth shutoff valve 164 may be excluded in a configuration achieving heat recovery by the exhaust air treatment unit 130B during outdoor air cooling operation. One or more embodiments exemplify the air conditioning system 100 adopting R32 having slight combustibility as the refrigerant. Alternatively, the air conditioning system according to the present disclosure may adopt a noncombustible refrigerant.

The air conditioning system 100 further includes the indoor unit 120 disposed in the second space S12 different from the first space S11. The utilization refrigerant circuit RC4 in the indoor unit 120 configured to condition air in the second space S12 is individually connected to the heat source refrigerant circuit RC1 by the first connection pipe 11 and the third connection pipe 13. During cooling operation, the air conditioning system 100 can thus execute outdoor air cooling operation for the first space S11 with use of the first heat recovery unit 130 as well as can continue cooling operation in the second space S12, of the indoor unit 120 for the second space S12.

[Air Conditioning System According to Second Embodiments]

Figure 8:
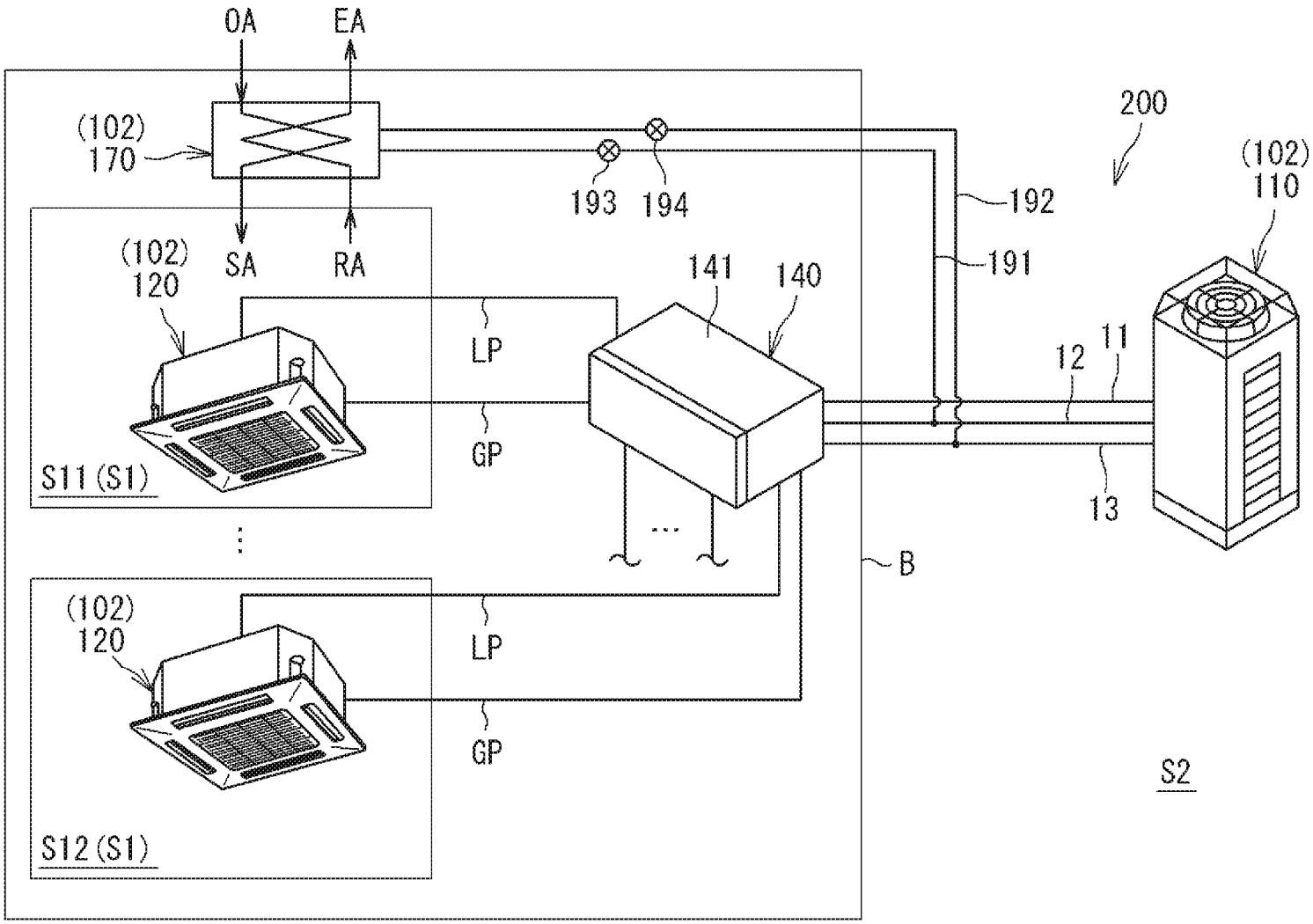
FIG. 8 is a schematic configuration diagram of an air conditioning system according to second embodiments of the present disclosure.
Figure 9:
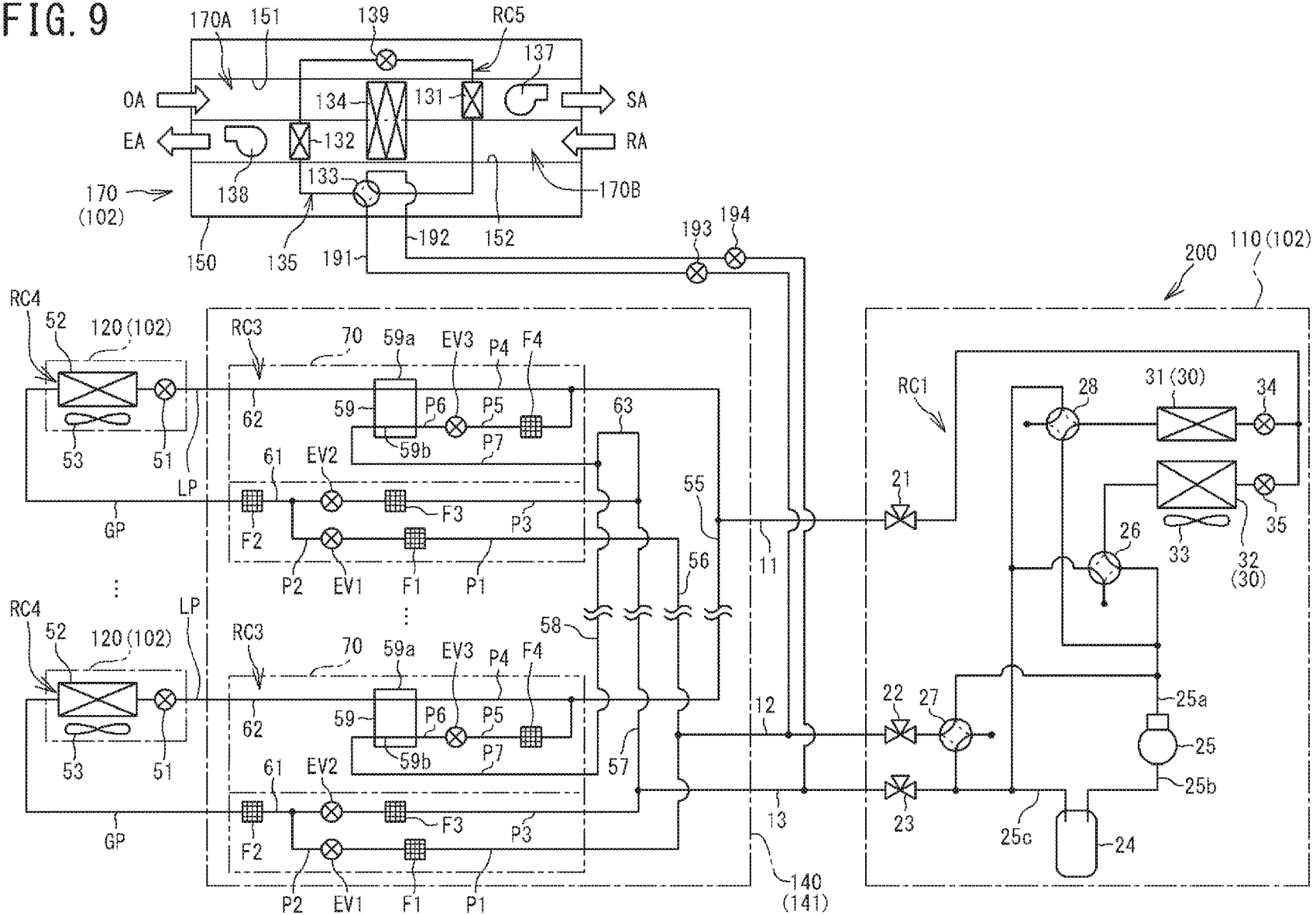
FIG. 9 is a refrigerant circuit diagram of the air conditioning system according to the second embodiments.
Figure 10:
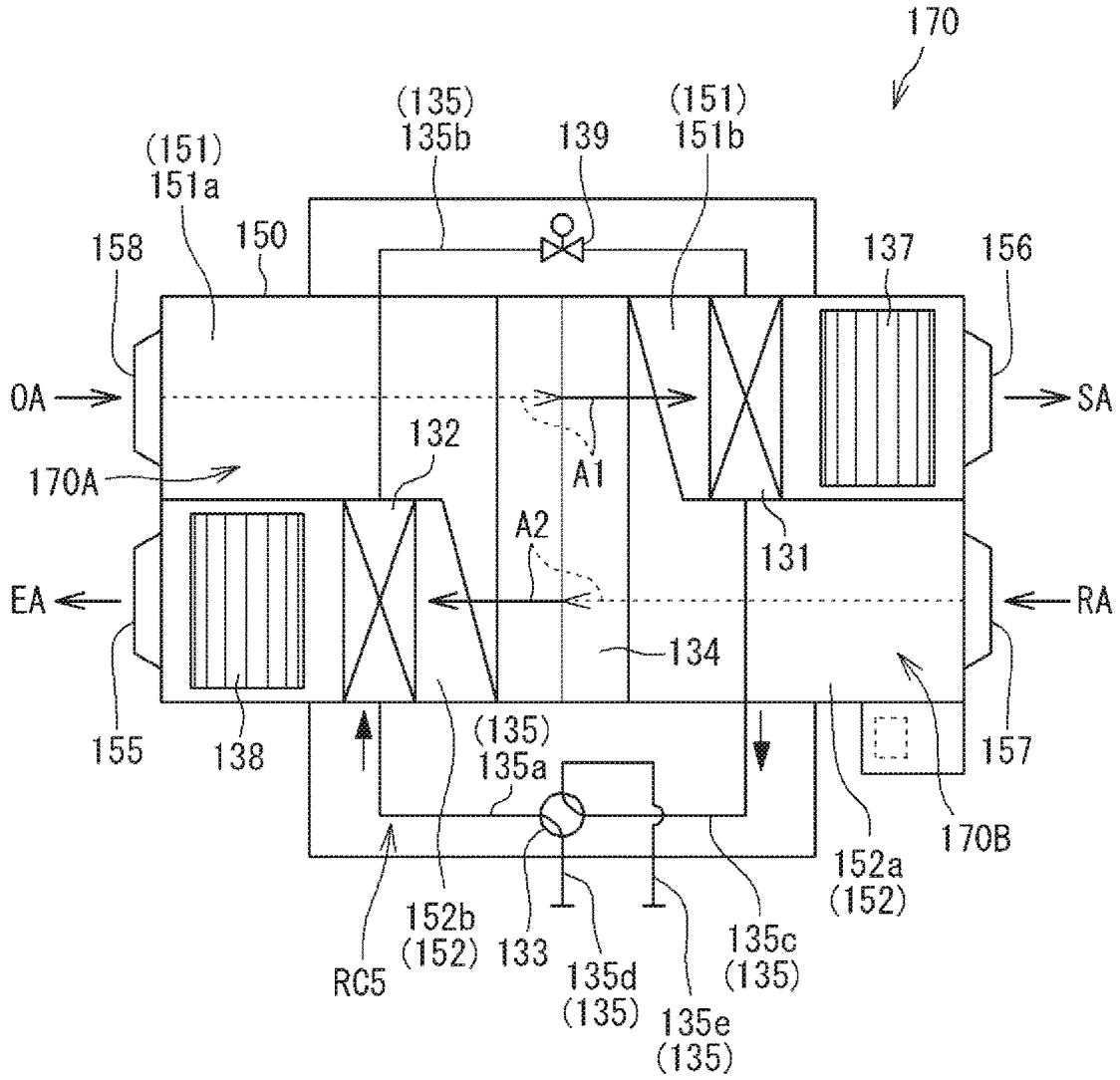
FIG. 10 is a schematic configuration diagram of a heat recovery unit according to the second embodiments.

FIG. 8 is a schematic diagram depicting an entire configuration of an air conditioning system according to the second embodiments of the present disclosure. FIG. 9 is a refrigerant circuit diagram of the air conditioning system according to the second embodiments. FIG. 10 is a schematic configuration diagram of a heat recovery unit according to the second embodiments. As depicted in FIG. 8, the present disclosure provides an air conditioning system 200 according to the second embodiments, including an air conditioner 102 and a refrigerant flow path switching device 140. The air conditioning system 200 is different from the air conditioning system 100 according to the first embodiments in that the air conditioner 102 is provided in place of the air conditioner 101. In FIG. 8 to FIG. 11, constituents same as the constituents described with reference to FIG. 1 to FIG. 7 are denoted by identical reference signs, and the following description will not refer to the constituents denoted by the identical reference signs unless otherwise specifically described.

[Configuration of Air Conditioner 102)

As depicted in FIG. 8 and FIG. 9, the air conditioner 102 includes the outdoor unit 110, the indoor unit 120, and a second heat recovery unit 170. In the air conditioner 102, two or more indoor units 120 and a single second heat recovery unit 170 are connected to the single outdoor unit 110. In the air conditioner 102, the refrigerant flow path switching device 140 is configured to freely select cooling operation or heating operation for each of the indoor units 120 to achieve air conditioning of the target space. The air conditioner 102 is different from the air conditioner 101 according to the first embodiments in that the second heat recovery unit 170 is provided in place of the first heat recovery unit 130.

[Configuration of Second Heat Recovery Unit]

The second heat recovery unit 170 is configured to ventilate the indoor space S1, and is disposed outside the indoor space S1 in the building B. The second heat recovery unit 170 is disposed in a ceiling space above the indoor space S1, and is connected to the indoor space S1 and the outdoor space S2 via ducts. One or more embodiments exemplify the case where the second heat recovery unit 170 is disposed in the ceiling space above the indoor space S1. Alternatively, the second heat recovery unit according to the present disclosure may be of the ceiling pendant type, the ceiling embedded type, the floor-standing type, or the wall mounted type, and may be disposed at a position other than the ceiling space. As depicted in FIG. 10, the second heat recovery unit 170 includes the supply air auxiliary heat exchanger 131, the exhaust air auxiliary heat exchanger 132, the auxiliary heat exchanger switching valve 133, and the heat exchange unit 134. The second heat recovery unit 170 includes an outdoor air treatment unit 170A and an exhaust air treatment unit 170B. The outdoor air treatment unit 170A includes the supply air auxiliary heat exchanger 131, whereas the exhaust air treatment unit 170B includes the exhaust air auxiliary heat exchanger 132. The second heat recovery unit 170 is provided therein with a third auxiliary refrigerant circuit RC5. The third auxiliary refrigerant circuit RC5 is constituted by the supply air auxiliary heat exchanger 131, the exhaust air auxiliary heat exchanger 132, and the auxiliary heat exchanger switching valve 133 connected by an auxiliary refrigerant pipe 135. The auxiliary refrigerant pipe 135 includes a first auxiliary refrigerant tube 135*a*, a second auxiliary refrigerant tube 135*b*, a third auxiliary refrigerant tube 135*c*, a fourth auxiliary refrigerant tube 135*d*, and a fifth auxiliary refrigerant tube 135*e*.

The supply air auxiliary heat exchanger 131 has a first side end connected to the third auxiliary refrigerant tube 135*c* extending from the auxiliary heat exchanger switching valve 133. The supply air auxiliary heat exchanger 131 has a second side end connected to a first end of the second auxiliary refrigerant tube 135*b*. The second auxiliary refrigerant tube 135*b* has a second end connected to a first side end of the exhaust air auxiliary heat exchanger 132. The second auxiliary refrigerant tube 135*b* has a halfway portion provided with a motor valve 139. The motor valve 139 has an adjustable opening degree. The exhaust air auxiliary heat exchanger 132 has a second side end connected to the first auxiliary refrigerant tube 135*a* extending from the auxiliary heat exchanger switching valve 133.

The auxiliary heat exchanger switching valve 133 is a four-way switching valve having four ports connected respectively with the first auxiliary refrigerant tube 135*a*, the second auxiliary refrigerant tube 135*b*, the fourth auxiliary refrigerant tube 135*d*, and the fifth auxiliary refrigerant tube 135*e*.

As depicted in FIG. 9 and FIG. 10, the fourth auxiliary refrigerant tube 135*d* is connected to a seventh branching pipe 191, and the fifth auxiliary refrigerant tube 135*e* is connected to an eighth branching pipe 192. The auxiliary heat exchanger switching valve 133 switches refrigerant flows among the first auxiliary refrigerant tube 135*a*, the second auxiliary refrigerant tube 135*b*, the fourth auxiliary refrigerant tube 135*d*, and the fifth auxiliary refrigerant tube 135*e*.

The third auxiliary refrigerant circuit RC5 is connected to the second connection pipe 12 on a high-pressure gas side via the seventh branching pipe 191, and is connected to the third connection pipe 13 on a low-pressure gas side via the eighth branching pipe 192.

(Configuration of Control Unit)

Figure 11:
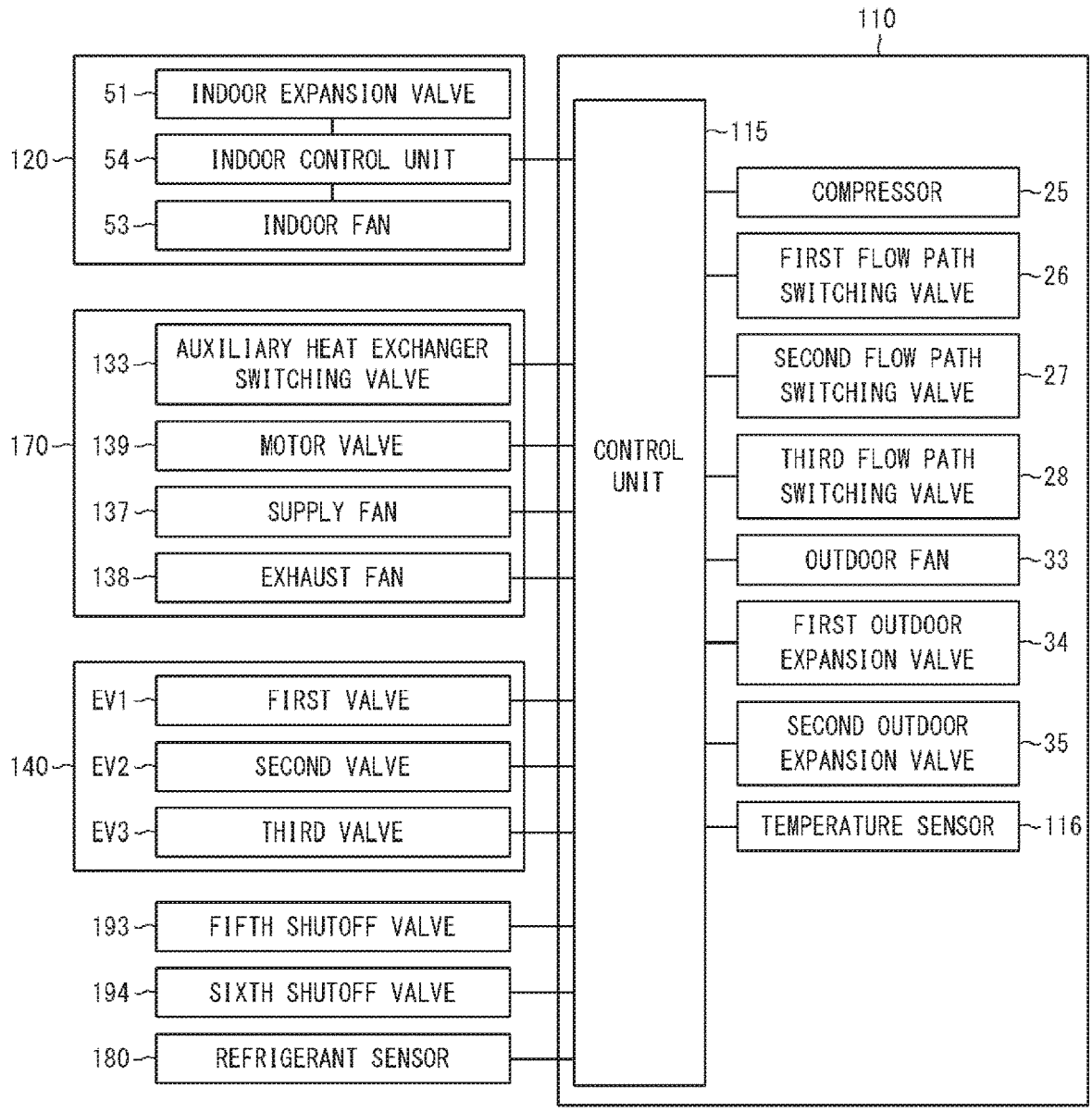
FIG. 11 is a control block diagram of the air conditioning system according to the second embodiments.

FIG. 11 is a control block diagram of the air conditioning system 200. As depicted in FIG. 11, the control unit 115 in the air conditioning system 200 is connected with the compressor 25, the first flow path switching valve 26, the second flow path switching valve 27, the third flow path switching valve 28, the outdoor fan 33, the first outdoor expansion valve 34, and the second outdoor expansion valve 35, which are incorporated in the outdoor unit 110. The control unit 115 is connected with the indoor expansion valve 51 and the indoor fan 53 via the indoor control unit 54 in the indoor unit 120. The control unit 115 is connected with the auxiliary heat exchanger switching valve 133 of the second heat recovery unit 170, the motor valve 139, the supply fan 137, and the exhaust fan 138. The control unit 115 is connected with the first valve EV1, the second valve EV2, and the third valve EV3 via the control unit (not depicted) of the refrigerant flow path switching device 140 (the switching unit 70). The control unit 115 is connected with a fifth shutoff valve 193 and a sixth shutoff valve 194. The control unit 115 is connected with the temperature sensor 116 and the refrigerant sensor 180. The control unit 115 controls behavior of the above connected constituents in accordance with an operation situation of the air conditioning system 200. Alternatively in the air conditioning system 200, the second heat recovery unit 170 may include a control unit (not depicted), and the control unit 115 may be connected with the auxiliary heat exchanger switching valve 133, the motor valve 139, the supply fan 137, and the exhaust fan 138 via the control unit (not depicted) of the second heat recovery unit 170.

(Regarding Outdoor Air Cooling Operation)

Upon execution of outdoor air cooling operation, the air conditioning system 200 stops the indoor unit 120 and continues ventilation with use of the second heat recovery unit 170. Specifically in the air conditioning system 200, if the outdoor air temperature T detected by the temperature sensor 116 is less than the set temperature TS while the indoor unit 120 is cooling the first space S11, the control unit 115 closes the fifth shutoff valve 193 and the sixth shutoff valve 194 and operates the supply fan 137. The air conditioning system 200 can thus switch air conditioning for the first space S11 from normal cooling operation to outdoor air cooling operation.

As described above, the air conditioning system 200 shuts off the refrigerant passing the supply air auxiliary heat exchanger 131 during outdoor air cooling operation. During outdoor air cooling operation, the air conditioning system 200 can thus operate only the supply fan 137 without heat exchange by the supply air auxiliary heat exchanger 131, for efficient operation of the air conditioning system 200.

The air conditioning system 200 further includes the indoor unit 120 disposed in the second space S12 different from the first space S11. The utilization refrigerant circuit RC4 in the indoor unit 120 configured to condition air in the second space S12 is individually connected to the heat source refrigerant circuit RC1 by the first connection pipe 11 and the third connection pipe 13. During cooling operation, the air conditioning system 200 can thus execute outdoor air cooling operation for the first space S11 with use of the second heat recovery unit 170 as well as can continue cooling operation in the second space S12, of the indoor unit 120 for the second space S12.

(Regarding Refrigerant Accumulation Into Second Heat Recovery Unit)

With reference to FIG. 9, description is made to a state of the second heat recovery unit 170 when the air conditioning system 200 is stopped but the fans 137 and 138 in the second heat recovery unit 170 are in operation. In a case where the indoor unit 120 does not need to execute cooling operation for the second space S12 and the second heat recovery unit 170 executes outdoor air cooling operation for the first space S11 in a season of cooling operation, the indoor units 120 in the spaces S11 and S12 are stopped whereas the fans 137 and 138 in the second heat recovery unit 170 are in operation. In this case, the fifth shutoff valve 193 and the sixth shutoff valve 194 are closed to prevent refrigerant accumulation into the second heat recovery unit 170.

(Regarding Behavior of Shutoff Valves Upon Refrigerant Leakage)

In the air conditioning system 200, the refrigerant sensor 180 (see FIG. 11) is disposed at a position enabling sensing of any refrigerant leaking from the second heat recovery unit 170. When the refrigerant sensor 180 senses any refrigerant, the control unit 115 operates the fifth shutoff valve 193 and the sixth shutoff valve 194. When the fifth shutoff valve 193 and the sixth shutoff valve 194 operate in the air conditioning system 200, the third auxiliary refrigerant circuit RCS of the second heat recovery unit 170 is completely separated from the remaining refrigerant circuits RC1, RC3, and RC4 in the air conditioning system 200. Even if the refrigerant (R32 in one or more embodiments) having combustibility leaks from the second heat recovery unit 170, the air conditioning system 200 can thus inhibit leakage from the second heat recovery unit 170 of the refrigerant having quantity exceeding the refrigerant being stored in the third auxiliary refrigerant circuit RCS.

[Other Modification Examples]

The air conditioning systems 100 and 200 described above include the air conditioners 101 and 102 of a freely cooling and heating type, respectively. Alternatively, the air conditioning system according to the present disclosure may include an air conditioner of a type other than the freely cooling and heating type, and may include a heat pump air conditioner of a cooling and heating switching type.

[Functional Effects of Embodiments]

The air conditioning system 100 according to the first embodiments includes: the outdoor unit 110 having the heat source refrigerant circuit RC1 including the compressor 25 and the outdoor heat exchanger 30; the indoor unit 120 disposed in the first space S11 and having the utilization refrigerant circuit RC4 including the indoor heat exchanger 52; the first connection pipe 11 on the liquid side and the third connection pipe 13 on the gas side connecting the heat source refrigerant circuit RC1 and the utilization refrigerant circuit RC4; the outdoor air treatment unit 130A having the first auxiliary refrigerant circuit RC21 including the supply air auxiliary heat exchanger 131 connected to the first branching pipe 14 branching from the first connection pipe 11 and the second branching pipe 15 branching from the third connection pipe 13, and the supply fan 137 configured to supply the first space S11 with the outdoor air OA having passed the supply air auxiliary heat exchanger 131; the first shutoff valve 161 provided on the first branching pipe 14; and the second shutoff valve 162 provided on the second branching pipe 15. In the air conditioning system 100, the first shutoff valve 161 and the second shutoff valve 162 operate to shut off a refrigerant flow between the heat source refrigerant circuit RC1 and the first auxiliary refrigerant circuit RC21.

In the configuration described above, the first shutoff valve 161 and the second shutoff valve 162 can completely separate the first auxiliary refrigerant circuit RC21 from the heat source refrigerant circuit RC1. This enables inhibition of evaporation, condensation, and the like of the refrigerant in the first auxiliary refrigerant circuit RC21 in the state where the outdoor air treatment unit 130A is stopped, to inhibit deterioration in operation efficiency of the air conditioning system 100.

The air conditioning system 100 according to the first embodiments includes: the temperature sensor 116 configured to detect outdoor air temperature; and the control unit 115 configured to operate the supply fan 137 in accordance with the outdoor air temperature detected by the temperature sensor 116.

When the outdoor air temperature is less than the predetermined set temperature while the first space S11 is cooled, the control unit 115 in the air conditioning system 100 closes the first shutoff valve 161 and the second shutoff valve 162 and operates the supply fan 137.

This configuration shuts off the refrigerant passing the supply air auxiliary heat exchanger 131 if the outdoor air temperature is less than the predetermined temperature while the first space S11 is cooled, so as to operate only the supply fan 137 for outdoor air cooling operation in the first space S11.

The air conditioning system 100 according to the first embodiments further includes the indoor unit 120 disposed in the second space S12 different from the first space S11 and having the utilization refrigerant circuit RC4 including the indoor heat exchanger 52, and the utilization refrigerant circuit RC4 is connected to the heat source refrigerant circuit RC1 by the first connection pipe 11 and the third connection pipe 13.

This configuration enables, during cooling operation, outdoor air cooling operation in the first space S11 provided with the supply fan 137 with use of only the supply fan 137 of the outdoor air treatment unit 130A or 170A, as well as continuous cooling operation of the indoor unit 120 in the second space S12.

The air conditioning system 100 according to the first embodiments further includes: the exhaust air treatment unit 130B having the second auxiliary refrigerant circuit RC22 including the exhaust air auxiliary heat exchanger 132 connected to the third branching pipe 16 branching from the first connection pipe 11 and the fourth branching pipe 17 branching from the third connection pipe 13, and the exhaust fan 138 configured to discharge to outside, air existing in the first space S11 and having passed the exhaust air auxiliary heat exchanger 132; and the third shutoff valve 163 provided on the third branching pipe 16. When the outdoor air temperature is less than the predetermined temperature while the first space S11 is cooled, the control unit 115 in the air conditioning system 100 opens the third shutoff valve 163 and operates the exhaust fan 138.

When outdoor air cooling operation is executed for the first space S11 and cooling operation is executed for the second space S12 during cooling operation, the exhaust air auxiliary heat exchanger 132 in this configuration recovers heat from exhaust air of the first space S11 to achieve efficient operation of the air conditioning system 100.

The air conditioning system 100 according to the first embodiments further includes: the casing 150 accommodating the first auxiliary refrigerant circuit RC21, the second auxiliary refrigerant circuit RC22, the supply fan 137, and the exhaust fan 138, and provided with the supply air passage 151 for air passing the supply air auxiliary heat exchanger 131 and the exhaust air passage 152 for air passing the exhaust air auxiliary heat exchanger 132; and the heat exchange unit 134 configured to cause heat exchange between the air in the supply air passage 151 before passing the supply air auxiliary heat exchanger 131 and the air in the exhaust air passage 152 before passing the exhaust air auxiliary heat exchanger 132.

In this configuration, the single casing 150 accommodates the outdoor air treatment unit 130A, the exhaust air treatment unit 130B, and the heat exchange unit 134, to simplify a pipe configuration around the first heat recovery unit 130. This facilitates connecting work for the heat source refrigerant circuit RC1, the first auxiliary refrigerant circuit RC21, and the second auxiliary refrigerant circuit RC22.

The air conditioning system 100 according to the first embodiments adopts, as the refrigerant, a combustible refrigerant (refrigerant R32).

This configuration suppresses quantity of any refrigerant leaking from the first heat recovery unit 130 by closing the first to fourth shutoff valves 161 to 164 if the heat recovery unit has refrigerant leakage.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

11 first connection pipe
13 third connection pipe

14 first branching pipe
15 second branching pipe
16 third branching pipe
17 fourth branching pipe
25 compressor
30 outdoor heat exchanger (first heat exchanger)
52 indoor heat exchanger (second heat exchanger, third heat exchanger)
100 air conditioning system (first embodiments)
110 outdoor unit (first unit)
115 control unit (controller)
116 temperature sensor
120 indoor unit (second unit, third unit)
130A outdoor air treatment unit
130B exhaust air treatment unit
131 supply air auxiliary heat exchanger (first auxiliary heat exchanger)
132 exhaust air auxiliary heat exchanger (second auxiliary heat exchanger)
134 heat exchange unit
137 supply fan
138 exhaust fan
150 casing
151 supply air passage
152 exhaust air passage
161 first shutoff valve
162 second shutoff valve
163 third shutoff valve
RC1 heat source refrigerant circuit (first refrigerant circuit)
RC21 supply air auxiliary refrigerant circuit (first auxiliary refrigerant circuit)
RC22 exhaust air auxiliary refrigerant circuit (second auxiliary refrigerant circuit)
RC4 utilization refrigerant circuit (second refrigerant circuit, third refrigerant circuit)
S11 first space
S12 second space
T outdoor air temperature
TS set temperature (predetermined temperature)

What is claimed is:

1. An air conditioning system comprising:
an outdoor unit that comprises a first refrigerant circuit comprising:
a compressor; and
a first heat exchanger;
an indoor unit in a first space and that comprises a second refrigerant circuit comprising a second heat exchanger;
a liquid side pipe and a gas side pipe each connecting the first refrigerant circuit to the second refrigerant circuit;
an outdoor air treatment unit comprising:
a first auxiliary refrigerant circuit comprising a first auxiliary heat exchanger connected to:
a first branching pipe branching from the liquid side pipe, and
a second branching pipe branching from the gas side pipe; and
a supply fan that supplies outdoor air having passed through the first auxiliary heat exchanger to the first space;
a switching valve on the second branching pipe configured to be switched according to cooling and heating operations of the air conditioning system;
a first shutoff valve on the first branching pipe;
a second shutoff valve on the second branching pipe between the first auxiliary heat exchanger and the switching valve; and
a motor valve on the first branching pipe configured to control quantity of refrigerant passing through the first auxiliary heat exchanger, wherein
the first shutoff valve and the second shutoff valve each shut off a flow of refrigerant between the first refrigerant circuit and the first auxiliary refrigerant circuit.

2. The air conditioning system according to claim 1, further comprising:
a temperature sensor that measures temperature of the outdoor air; and
a controller configured to operate the supply fan in accordance with the temperature measured by the temperature sensor, wherein
in response to the first space being cooled and the temperature being less than predetermined temperature, the controller:
closes the first shutoff valve and the second shutoff valve, and operates the supply fan.

3. The air conditioning system according to claim 1, further comprising:
another indoor unit in a second space different from the first space and that comprises a third refrigerant circuit comprising a third heat exchanger, wherein
the liquid side pipe and the gas side pipe each connect the third refrigerant circuit to the first refrigerant circuit.

4. The air conditioning system according to claim 1, further comprising:
an exhaust air treatment unit that comprises:
a second auxiliary refrigerant circuit comprising a second auxiliary heat exchanger connected to:
a third branching pipe branching from the liquid side pipe, and
a fourth branching pipe branching from the gas side pipe, and
an exhaust fan that discharges to outside air in the first space and having passed through the second auxiliary heat exchanger;
a third shutoff valve on the third branching pipe;
a temperature sensor that measures temperature of the outdoor air; and
a controller configured to operate the exhaust fan in accordance with the temperature measured by the temperature sensor, wherein
in response to the first space being cooled and the temperature being less than predetermined temperature, the controller:
opens the third shutoff valve, and
operates the exhaust fan.

5. The air conditioning system according to claim 4, further comprising:
a casing that:
accommodates:
the first auxiliary refrigerant circuit;
the second auxiliary refrigerant circuit;
the supply fan; and
the exhaust fan, and
comprises:
a supply air passage for air passing through the first auxiliary heat exchanger, and
an exhaust air passage for air passing through the second auxiliary heat exchanger; and
a heat exchange unit that exchanges heat between:
the air in the supply air passage before passing through the first auxiliary heat exchanger, and
the air in the exhaust air passage before passing through the second auxiliary heat exchanger.

6. The air conditioning system according to claim 1, wherein the refrigerant is combustible.

* * * * *